US006839408B2

(12) United States Patent
Tang

(10) Patent No.: US 6,839,408 B2
(45) Date of Patent: Jan. 4, 2005

(54) TWO-DIMENSIONAL, ANTI-SCATTER GRID AND COLLIMATOR DESIGNS, AND ITS MOTION, FABRICATION AND ASSEMBLY

(75) Inventor: Cha-Mei Tang, Potomac, MD (US)

(73) Assignee: Creatv Micro Tech, Inc., Potomac, MD (US)

( * ) Notice: Subject to any disclaimer, the term of this patent is extended or adjusted under 35 U.S.C. 154(b) by 83 days.

(21) Appl. No.: 09/734,761

(22) Filed: Dec. 13, 2000

(65) Prior Publication Data

US 2002/0037070 A1 Mar. 28, 2002

Related U.S. Application Data

(63) Continuation-in-part of application No. 09/459,597, filed on Dec. 13, 1999, now Pat. No. 6,252,938.

(51) Int. Cl.[7] ..... G21K 1/00
(52) U.S. Cl. ..... 378/154; 378/155
(58) Field of Search ..... 378/154, 155

(56) References Cited

U.S. PATENT DOCUMENTS

| | | | | |
|---|---|---|---|---|
| 4,433,427 | A | | 2/1984 | Barnea |
| 4,688,242 | A | | 8/1987 | Ema |
| 5,190,637 | A | | 3/1993 | Guckel |
| 5,206,983 | A | | 5/1993 | Guckel et al. |
| 5,231,654 | A | | 7/1993 | Kwasnick et al. |
| 5,263,075 | A | | 11/1993 | McGann et al. |
| 5,378,583 | A | | 1/1995 | Guckel et al. |
| 5,379,336 | A | | 1/1995 | Kramer et al. |
| 5,418,833 | A | | 5/1995 | Logan |
| 5,496,668 | A | | 3/1996 | Guckel et al. |
| 5,524,041 | A | | 6/1996 | Grenier |
| 5,576,147 | A | | 11/1996 | Guckel et al. |
| 5,606,589 | A | | 2/1997 | Pellegrino et al. |
| 5,625,192 | A | | 4/1997 | Oda et al. |
| 5,729,585 | A | | 3/1998 | Pellegrino et al. |
| 5,814,235 | A | | 9/1998 | Pellegrino et al. |
| 5,847,398 | A | | 12/1998 | Shahar et al. |
| 5,949,850 | A | | 9/1999 | Tang |
| 5,966,424 | A | | 10/1999 | Liu |
| 5,970,118 | A | * | 10/1999 | Sokolov ..... 378/155 |
| 6,252,938 | B1 | | 6/2001 | Tang |

OTHER PUBLICATIONS

H.E. Johns et al., "The Physics of Radiology", Charles C. Thomas, Springfield, Illinois, 1983, pp. 134–166, 734–736.
Olga V. Makarova et al., "Microfabrication of Freestanding Metal Structures Released from Graphite Substrates", *IEEE*, pp. 400–402.

(List continued on next page.)

*Primary Examiner*—Craig E Church
(74) *Attorney, Agent, or Firm*—Roylance, Abrams, Berdo & Goodman, LLP

(57) ABSTRACT

A grid, for use with electromagnetic energy emitting devices, includes at least metal layer, which is formed, for example, by electroplating. The metal layer includes top and bottom surfaces, and a plurality of solid integrated walls. Each of the solid integrated walls extends from the top to bottom surface and having a plurality of side surfaces. The side surfaces of the solid integrated walls are arranged to define a plurality of openings extending entirely through the layer. At least some of the walls also can include projections extending into the respective openings formed by the walls. The projections can be of various shapes and sizes, and are arranged so that a total amount of wall material intersected by a line propagating in a direction along an edge of the grid is substantially the same as another total amount of wall material intersected by another line propagating in another direction substantially parallel to the edge of the grid at any distance from the edge.

55 Claims, 38 Drawing Sheets

OTHER PUBLICATIONS

Cha–Mei Tang et al., "Experimental and Simulation Results of Two–Dimensional Prototype Anti–Scatter Grids for Mammography", World Congress on Medical Physics and Biomedical Engineering, Chicago, 2000.
Kevin Fischer et al., "Fabrication of Two–Dimensional X–Ray Anti–Scatter Grids for Mammography", Advances in X–Ray Opticas, Andreas K. Freund et al., editors, *Proceedings of SPIE* vol. 4145, 2001, pp. 227–234.
John M. Boon, Ph.D. et al., "Grid and Slot Scan Scatter Reduction In Mammography: Comparison by Using Monte Carlo Techniques", *Radiology,* vol. 222, Feb. 2002, pp. 519–527.
Cha–Mei Tang et al., "Precision Fabrication of Two–Dimensional Anti–Scatter Grids, In Medical Imagining 2000: Physics of Medical Imagining", James T. Dobbins III and John M. Boone, editors; *Proceedings of SPIE,* vol. 3977, 2000, pp. 647–657.
Olga V. Makarova et al., "Development of Freestanding Copper Anti–scatter Grid Using Deep X–ray Lithography". C.M. Tang, Small Business Information Research Solicitation No. DOE/ER–0686, 21 pages (Mar. 1, 1997).
C.M. Tang et al., "Anti–Scattering X–Ray Grid", *Microsystem Technologies,* pp. 187–192 (1998).
Larry E. Antonuk et al., "A Large–Area, 97 μm Pitch, Indirect–Detection, Active Matrix, Flat–Panel Imager (AMFPI)", *Part of the SPIE Conference of Medical Imaging, San Diego, CA,* SPIE vol. 3336, pp. 2–13, (Feb. 1998).
Radiological Society of North America, 80$^{th}$ Scientific Assembly and Annual Meeting, Nov. 27–Dec. 2, 1994, p. 253.
Denny L. Lee et al., "Improved Imaging Performance of a 14×17–inch Direct Radiography™ System Using Se/TFT Detector", *Part of the SPIE Conference on Physics of Medical Imaging, San Diego, CA,* SPIE vol. 3336, pp. 14–23 (Feb. 1998).
Robert Street et al., "Large Area X–Ray Image Sensing Using a PbI2 Photoconductor", *Part of the SPIE Conference on Physics of Medical Imaging, San Diego, CA,* SPIE vol. 3336, pp. 24–32 (Feb. 1998).
Tom J.C. Bruijns et al., "Technical and Clinical Results of an Experimental Flat Dynamic (Digital) X–ray Image Detector (FDXD) System with Real–Time Corrections", *Part of the SPIE Conference on Physics of Medical Imaging, San Diego, CA,* SPIE vol. 3336, pp. 33–44, (Feb. 1998).
Christophe Chaussat et al., "New CsI/a–Si 17"×17" X–Ray Flat Panel Detector Provides Superior Detectivity and Immediate Direct Digital Output for General Radiography Systems", *Part of the SPIE Conference on Physics of Medical Imaging, San Diego, CA,* SPIE vol. 3336, pp. 45–56 (Feb. 1998).
Hans Roehrig et al., "Flat–Panel Detector, CCD Cameras and Electron Beam Tube Based Video Camera for Use in Portal Imaging", *Part of the SPIE Conference on Physics of Medical Imaging, San Diego, CA,* SPIE vol. 3336, pp. 163–174 (Feb. 1998).
Herbert D. Zeman et al., "Portal Imaging with a CsI(Tl) Transparent Scintillator X–Ray Detector", *Part of the SPIE Conference on Physics of Medical Imaging, San Diego, CA,* SPIE vol. 3336, pp. 175–186 (Feb. 1998).
Jean–Pierre Moy, "Image Quality of Scintillator Based X–ray Electronic Imagers", *Part of the SPIE Conference on Physics of Medical Imaging, San Diego, CA,* SPIE vol. 3336, pp. 187–194 (Feb. 1998).
G. Pang et al., "Electronic Portal Imaging Device (EPID) Based on a Novel Camera with Avalanche Multiplication", *Part of the SPIE Conference on Physics of Medical Imaging, San Diego, CA,* SPIE vol. 3336, pp. 195–203 (Feb. 1998).
Michael P. André et al., "An Integrated CMOS–Selenium X–Ray Detector for Digital Mammography", *Part of the SPIE Conference on Physics of Medical Imaging, San Diego, CA,* SPIE vol. 3336, pp. 204–209 (Feb. 1998).
Nicholas Petrick et al., "A Technique to Improve the Effective Fill Factor of Digital Mammographic Imagers", *Part of the SPIE Conference on Physics of Medical Imaging, San Diego, CA,* SPIE vol. 3336, pp. 210–217 (Feb. 1998).
Richard E. Colbeth et al., "Flat Panel Imaging System for Fluoroscopy Applications", *Part of the SPIE Conference on Physics of Medical Imaging, San Diego, CA,* SPIE vol. 3336, pp. 376–387 (Feb. 1998).
Akira Tsukamoto et al., "Development of a Selenium–Based Flat–Panel Detector for Real–Time Radiography and Fluoroscopy", *Part of the SPIE Conference on Physics of Medical Imaging, San Diego, CA,* SPIE vol. 3336, pp. 388–395 (Feb. 1998).
N. Jung et al., "Dynamic X–Ray Imaging System Based on an Amorphous Silicon Thin–Film Array", *Part of the SPIE Conference on Physics of Medical Imaging, San Diego, CA,* SPIE vol. 3336, pp. 396–407 (Feb. 1998).
Dylan C. Hunt et al., "Detective Quantum Efficiency of Direct, Flat Panel X–ray Imaging Detectors for Fluoroscopy", *Part of the SPIE Conference on Physics of Medical Imaging, San Diego, CA,* SPIE vol. 3336, pp. 408–417 (Feb. 1998).
Cornelis H. Slump et al., "Real–Time Diagnostic Imaging with a Novel X–ray Detector with Multiple Screen—CCD Sensors", *Part of the SPIE Conference on Physics of Medical Imaging, San Diego, CA,* SPIE vol. 3336, pp. 418–429 (Feb. 1998).
Edmund L. Baker et al., "A Physical Image Quality Evaluation of a CCD–Based X–ray Image Intensifier Digital Fluorography System for Cardiac Applications", *Part of the SPIE Conference on Physics of Medical Imaging, San Diego, CA,* SPIE vol. 3336, pp. 430–441 (Feb. 1998).
Richard L. Weisfield et al., "New Amorphous–Silicon Image Sensor for X–Ray Diagnostic Medical Imaging Applications", *Part of the SPIE Conference on Physics of Medical Imaging, San Diego, CA,* SPIE vol. 3336, pp. 444–452 (Feb. 1998).
Toshio Kameshima et al., "Novel Large Area MIS–Type X–Ray Image Sensor for Digital Radiography", *Part of the SPIE Conference on Physics of Medical Imaging, San Diego, CA,* SPIE vol. 3336, pp. 453–462 (Feb. 1998).
Gary S. Shaber et al., "Clinical Evaluation of a Full Field Digital Projection Radiography Detector", *Part of the SPIE Conference on Physics of Medical Imaging, San Diego, CA,* SPIE vol. 3336, pp. 463–469 (Feb. 1998).
Donald R. Ouimette et al., "A New Large Area X–Ray Image Sensor", *Part of the SPIE Conference on Physics of Medical Imaging, San Diego, CA,* SPIE vol. 3336, pp. 470–476 (Feb. 1998).
David P. Trauernicht and John Yorkston, "Screen Design for Flat–Panel Imagers in Diagnostic Radiology", *Part of the SPIE Conference on Physics of Medical Imaging, San Diego, CA,* pp. 477–485 (Feb. 1998).
John Rowlands and Safa Kasap, "Amorphous Semiconductors Usher in Digital X–Ray Imaging", *Physics Today,* pp. 24–30 (Nov. 1997).

N.M. Allinson, "Development of Non–Intensified Charge–Coupled Device Area X–Ray Detectors", *Journal of Synchrotron Radiation,* pp. 54–62 (1994).
I.M. Blevis et al., "Digital Radiology Using Amorphous Selenium and Active Matrix Flat Panel Readout: Photoconductive Gain and Gain Fluctuations", *Medical Imaging Research, Sunnybrook Science Center, University of Toronto,* 8 pages.
Justin M. Henry et al., "Noise in Hybrid Photodiode Array—CCD X–Ray Image Detectors for Digital Mammography", SPIE vol. 2708, pp. 106–115 (Feb. 1998).
"DpiX' Digital X–Rays for Diagnosis and Treatment",*The Clock,* pp. 3, 5 and 19–21 (Dec. 1997/Jan. 1998).
Russell C. Hardie et al., "Joint MAP Registration and High–Resolution Image Estimation Using a Sequence of Undersampled Images", *IFEE Transactions on Image Processing,* vol. 6 No. 12, pp. 1621–1632 (Dec. 1997).
Joseph C. Gillette et al., "Aliasing Reduction in Staring Infrared Imagers Utilizing Subpixel Techniques", *Optical Engineering,* vol. 34, No. 11, pp. 3130–3137 (Nov. 1995).
Russell C. Hardie et al., "High–Resolution Image Reconstruction from a Sequence of Rotated and Translated Frames and its Application to an Infrared Imaging System", *Optical* Engineering, vol. 37, No. 1, pp. 247–260, (Jan. 1998).
Kai M. Hock, "Effect of Oversampling in Pixel Arrays", *Optical Engineering,* vol. 34, No. 5, pp. 1281–1288 (May 1995).
Kenneth J. Barnard et al. "Effects of Image Noise on Submicroscan Interpolation", *Optical Engineering,* vol. 34, No. 11, pp. 3165–3173 (Nov. 1995).
Kenneth J. Barnard et al., "Nonmechanical Microscanning Using Optical Space–Fed Phased Arrays", *Optical Engineering,* vol. 33, No. 9, pp. 3063–3071 (Sep. 1994).
Gerald C. Holst, *Sampling, Aliasing, and Data Fidelity,* pp. 98–130 (published prior to Feb. 18, 1999).
Larry E. Antonuk et al., "Demonstration of Megavoltage and Diagnostic X–Ray Imaging with Hydrogenated Amorphous Silicon Arrays", *Am. Assoc. Phys. Med.,* vol. 19, No. 6, pp. 1455–1466 (Nov./Dec. 1992).
E.W. Becker et al., "Fabrication of Microstructures with high aspect ratios and great structural heights by syncrotron Radiation Lithography, Galvanoforming, and Plastic Molding (LIGA Process)," Microelectronics Engineering, vol. 4 pp. 35–56 (1986).
Dr. P. Bley, "The Liga Process for Fabrication of Three–Dimensional Microscale Structures," *Interdisciplinary Sci. Rev.,* vol. 18, pp. 267–272 (1993).
"DARPA Awards Contract for X–Ray Lithography System", *Micromachine Devices,* vol. 2, No. 3, p. 2 (1997).
R.L. Egan, "Intramammary Calcifications Without an Associated Mass", *Radiology,* vol. 137, pp. 1–7 (1980).
H. Guckel, program and notes describing his "Invited talk at the American Vacuum Society Symposium", Philadelphia, PA, Oct. 1996.
"IBM Team Develops Ultrathick Negative Resist for MEMs Users", *Micromachine Devices,* vol. 2, No. 3, p. 1 (1997).
"X–Ray Lithography Scanners for LIGA", *Micromachine Devices,* vol. 1, No. 2, p. 8 (1996).
E.P. Muntz et al., "On the Significance of Very Small Angle Scattered Radiation to Radiographic Imaging at Low Energies", *Med. Phys.* vol. 10, pp. 819–823 (1983).
M.J. Yaffe et al., "X–Ray Detectors for Digital Radiography", *Phys. Med. Biol.,* vol. 42, pp. 1–39 (1997).
D.P. Siddons et al., "Precision Machining using Hard X–Rays", *Syncrotron Radiation News,* vol. 7, No. 2, pp. 16–18 (1994).
Computer printout of University of Wisconsin Web Site "http://mems.engr.wisc.edu/liga.html", entitled "UW–MEMS–Research–Deep X–ray Lithography" (web site information available to public prior to Jun. 19, 1987 filing date of present application).
Computer printout of University of Wisconsin Web Site "http://mems.engr.wisc.edu/pc.html" entitled "UW–MEMS–Research–Precision Engineering" (web site information available to public prior to Jun. 19, 1987 filing date of present application).
Computer printout of University of Wisconsin Web Site "http://mems.engr.wisc.edu/~guckel/homepage.html" (web site information available to public prior to Jun. 19, 1987 filing date of present application).
H. Guckel, "NATO Advanced Research Workshop on the Ultimate Limits of Fabrication and Measurement", *Proceedings of the Royal Society (Invited Talk/Paper),* pp. 1–15 (Apr. 1994).
H. Guckel et al., "Micromechanics via x–ray assisted processing", *Journal of Vacuum Science Technology,* pp. 2559–2564 (Jul./Aug. 1994).
W. Ehrfeld, "Coming to Terms with the Past and the Future", *LIGA News,* pp. 1–3 (Jan. 1995).
H. Guckel et al., "Micro Electromagnetic Actuators Based on Deep X–Ray Lithography", *MIMR '95, Sendai, Japan,* (Sep. 27–29, 1995).
H. Guckel et al., "Micromechanics for actuators via deep x–ray lithography", *Proceedings of SPIE, Orlando, Florida,* pp. 39–47 (Apr. 1994).
Z. Jing et al., "Imaging characteristics of plastic scintillating fiber screens for mammography", *SPIE,* vol. 2708, pp. 633–644 (Feb. 1996).
N. Nakamori et al., "Computer simulation on scatter removing characteristics by grid", *SPIE* vol. 2708, pp. 617–625 (Feb. 1996).
P. A. Tompkins et al., "Use of capillary optics as a beam intensifier for a Compton x–ray source", *Medical Physics,* vol. 21, No. 11, pp. 1777–1784 (Nov. 1994).
R. Fahrig et al., "Performance of Glass Fiber Antiscatter Devices at Mammographic Energies", *Am. Assoc. Phys. Med.,* vol. 21, No. 8, pp. 1277–1282 (Aug. 1994).
L.E. Antonuk et al., "Large Area, Flat–Panel, Amorphous Silicon Imagers", *SPIE* vol. 2432, pp. 216–227 (Jul. 1995).
H.E. Johns, OC, Ph.D., F.R.S.C., LL.D., D.Sc., F.C.C.P.M., *The Physics of Radiology,* Fourth Edition (Charles C. Thomas: Springfield, Illinois, 1983), p. 734.
Collimated Holes, Inc. Products Manual, pages entitled "Rectangular and Square Fibers/Fiber Arrays" (Apr. 1995) and "Scintillating Fiberoptic Faceplate Price List Type LKH–6" (Dec. 1995).
H. Guckel et al., "LIGA and LIGA–Like Processing with High Energy Photons", *Microsystems Technologies,* vol. 2, No. 3, pp. 153–156 (Aug. 1996).
H. Guckel et al., "Deep X–Ray Lithography for Micromechanics and Precision Engineering", *Synchrotron Radiation Instrumentation (Invited), Advanced Photon Source Argonne,* pp. 1–8 (Oct. 1995).

* cited by examiner

TWO-DIMENSIONAL, ANTI-SCATTER GRID AND COLLIMATOR DESIGNS, AND ITS MOTION, FABRICATION AND ASSEMBLY

This is a continuation-in-part of U.S. patent application Ser. No. 09/459,597, filed on Dec. 13, 1999, now U.S. Pat. No. 6,252,938, the entire contents of which being expressly incorporated herein by reference.

The invention was made with Government support under Grant Number 1 R43 CA76752-01 awarded by the National Institutes of Health, National Cancer Institute. The Government has certain rights in the invention.

BACKGROUND OF THE INVENTION

1. Field of the Invention

The present invention relates to a method and apparatus for making focused and unfocused grids and collimators which are movable to avoid grid shadows on an imager, and which are adaptable for use in a wide range of electromagnetic radiation applications, such as x-ray and gamma-ray imaging devices and the like. More particularly, the present invention relates to a method and apparatus for making focused and unfocused grids, such as air core grids, that can be constructed with a very high aspect ratio, which is defined as the ratio between the height of each absorbing grid wall and the thickness of the absorbing grid wall, and that are capable of permitting large primary radiation transmission therethrough.

2. Description of the Related Art

Anti-scatter grids and collimators can be used to eliminate the scattering of radiation to unintended and undesirable directions. Radiation with wavelengths shorter than or equal to soft x-rays can penetrate materials. The radiation decay length in the material decreases as the atomic number of the grid material increases or as the wavelength of the radiation increases. These grid walls, also called the septa and lamellae, can be used to reduce scattered radiation in ultraviolet, x-ray and gamma ray systems, for example. The grids can also be used as collimators, x-ray masks, and so on.

For scatter reduction applications, the grid walls preferably should be two-dimensional to eliminate scatter from all directions. For many applications, the x-ray source is a point source close to the imager. An anti-scatter grid preferablv should also be focused. Methods for fabricating and assembling focused and unfocused two-dimensional grids are described in U.S. Pat. No. 5,949,850, entitled "A Method and Apparatus for Making Large Area Two-dimensional Grids", the entire content of which is incorporated herein by reference.

When an anti-scatter grid is stationary during the acquisition of the image, the shadow of the anti-scatter grid will be cast on the imager, such as film or electronic digital detector, along with the image of the object. It is undesirable to have the grid shadow show artificial patterns.

The typical solution to eliminating the non-uniform shadow of the grid is to move the grid during the exposure. The ideal anti-scatter grid with motion will produce uniform exposure on the imager in the absence of any objects being imaged.

One-dimensional grids, also known as linear grids and composed of highly absorbing strips and highly transmitting interspaces which are parallel in their longitudinal direction, can be moved in a steady manner in one direction or in an oscillatory manner in the plane of the grid in the direction perpendicular to the parallel strips of highly absorbing lamellae. For two-dimensional grids, the motion can either be in one direction or oscillatory in the plane of the grid, but the grid shape needs to be chosen based on specific criteria.

The following discussion pertains to a two-dimensional grid with regular square patterns in the x-y plane, with the grid walls lined up in the x-direction and y-direction. If the grid is moving at a uniform speed in the x-direction, the film will show unexposed stripes along the x-direction, which also repeat periodically in the y-direction. The width of the unexposed strips is the same or essentially the same as the thickness of the grid walls. This grid pattern and the associated motion are unacceptable.

If the grid is moving at a uniform speed in the plane of the grid, but at a 45 degree angle from the x-axis, the image on the film or imager is significantly improved. However, strips of slightly overexposed film parallel to the direction of the motion at the intersection of the grid walls will still be present. As the grid moves in the x-direction at a uniform speed, the grid walls block the x-rays everywhere, except at the wall intersection, for the fraction of the time $$2d/D,$$

where d is the thickness of the grid walls and D is the periodicity of the grid walls. At the wall intersection, the grid walls blocks the x-rays for the fraction of the time $$2d/D<t<d/D,$$

depending on the location. Thus, stripes of slightly overexposed x-ray film are produced.

Methods for attempting to eliminate the overexposed strips discussed above are disclosed in U.S. Pat. Nos. 5,606,589, 5,729,585 and 5,814,235 to Pellegrino et al., the entire contents of each patent being incorporated herein by reference. These methods attempt to eliminate the overexposed strips by rotating the grid by an angle A, where A=atan (n/m), and m and n are integers. However, these methods are unacceptable or not ideal for many applications.

Accordingly, a need exists for a method and apparatus for eliminating the overexposed strips associated with two-dimensional focused or unfocused grid intersections.

SUMMARY OF THE INVENTION

An object of the present invention is to provide a grid where the walls focus to a point, a grid where the walls focus to a line or an unfocused grid with parallel walls that is configured to minimize grid shadow when the grid is moved during imaging.

Another object of the present invention, therefore, is to provide a method and apparatus for manufacturing a focused or unfocused grid which is configured to minimize overexposure at its wall intersections when the grid is moved during imaging.

A further object of the present invention is to provide a method and apparatus for moving a focused or unfocused grid so that no perceptible areas of variable density are cast by the grid onto the film or other two-dimensional electronic detectors.

These and other objects of the present invention are substantially achieved by providing a grid, adaptable for use with electromagnetic energy emitting devices. The grid comprises at least one solid metal layer, formed by electroplating. The solid metal layer comprises top and bottom surfaces, and a plurality of solid integrated, intersecting walls, each of which extending from the top to bottom surface and having a plurality of side surfaces. The side surfaces of the walls are arranged to define a plurality of openings extending entirely through the layer, and at least some of the side surfaces have projections extending into respective ones of the openings. The projections can be of various shapes and sizes, and are arranged so that a total amount of wall material intersected by a line propagating in a direction, for example, along an edge of the grid, for each period along the grid is substantially the same and is also substantially the same as another total amount of wall material intersected by another line for each period propagating in another direction substantially parallel to the edge of the grid at any distance from the edge.

These and other objects are further substantially achieved by providing a method for minimizing scattering of electromagnetic energy in an electromagnetic imaging device which is adapted to obtain an image of an object on an imager. The method includes placing a grid between an electromagnetic energy emitting source of the electromagnetic imaging device and the imager. The grid comprises at least one metal layer including top and bottom surfaces and a plurality of solid integrated, intersecting walls, each of which extending from the top to bottom surface and having a plurality of side surfaces, the side surfaces of the walls being arranged to define a plurality of openings extending entirely through the layer, and at least some of the side surface having projections extending into respective ones of the openings. The method further includes moving the grid in a grid moving pattern while the electromagnetic energy emitting source is emitting energy toward the imager.

BRIEF DESCRIPTION OF THE DRAWINGS

These and other features and advantages of the present invention will be more readily apprehended from the following detailed description when read in connection with the appended drawings, in which:

FIG. 21*b* shows the cross-section perpendicular to the sheet x-ray beam, and the x-ray mask and the substrate are tilted with respect to the sheet x-ray beam to form the focusing effect of the grid;

DETAILED DESCRIPTION OF THE PREFERRED EMBODIMENTS

Figure 1:
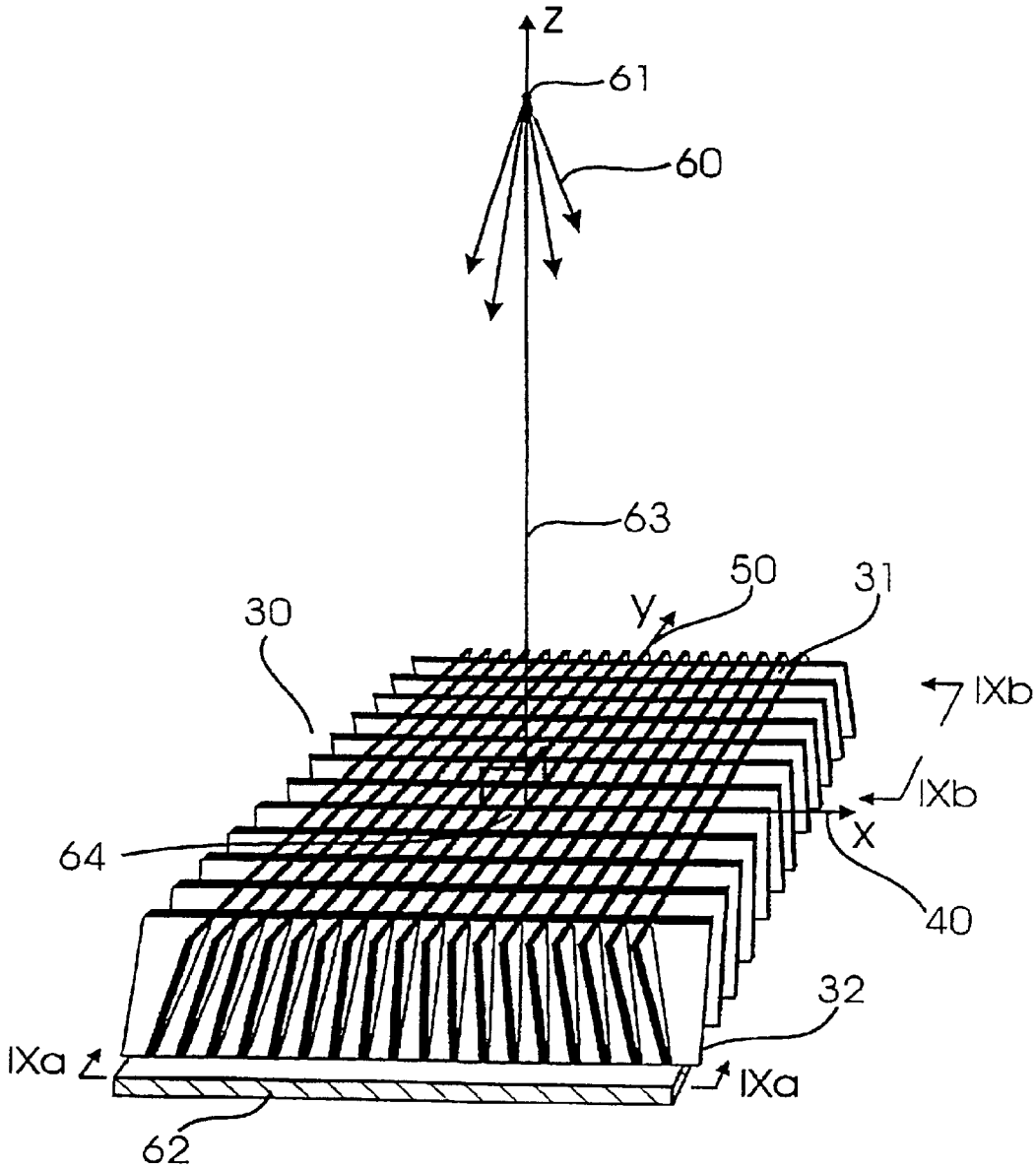
FIG. 1 shows a section of a focused stationary grid according to an embodiment of the present invention, in which the grid openings are focused to a point x-ray source.

The present invention provides a method and apparatus for making large area, two-dimensional, high aspect ratio, focused or unfocused x-ray anti-scatter grids, anti-scatter grid/scintillators, x-ray filters, and the like, as well as similar methods and apparatus for ultraviolet and gamma-ray applications. Referring now to the drawings, FIG. 1 shows a schematic of a section of a two-dimensional, focused anti-scatter grid 30 produced by a method of grid manufacture according to an embodiment of the present invention, as described in more detail in U.S. Pat. No. 5,949,850 referenced above.

The object to be imaged (not shown) is positioned between the x-ray source and the x-ray grid 30. The grid openings 31 which are defined by walls 32 are square in this example. However, the grid openings can be any practical shape as would be appreciated by one skilled in the methods of grid construction. The walls 32 are uniformly thick or substantially uniformly thick around each opening in this figure, but can vary in thickness as desired. The walls 32 are slanted at the same angle as the angle of the x-rays emanating from the point source, in order for the x-rays to propagate through the holes to the imager without significant loss. This angle increases for grid walls further away from the x-ray point source. In other words, an imaginary line extending from each grid wall 32 along the x-axis 40 could intersect the x-ray point source. A similar scenario exists for the grid walls 32 along the y-axis 50.

As shown, the x-ray propagates out of a point source 61 with a conical spread 60. The x-ray imager 62, which may be an electronic detector or x-ray film, for example, is placed adjacent and parallel or substantially parallel to the bottom surface of the x-ray grid 30 with the x-ray grid between the x-ray source 61 and the x-ray imager. Typically, the top surface of the x-ray grid 30 is perpendicular or substantially perpendicular to the line 63 that extends between the x-ray source and the x-ray grid 30.

To facilitate the description below. a coordinate system in which the grid 30 is omitted will now be defined. The z-axis is line 63. which is perpendicular or substantially perpendicular to the anti-scatter grid, and intersects the point x-ray source 61. The z=0 coordinate is defined as the top surface of the anti-scatter grid.

As further shown, the central ray 63 propagates to the center of the grid 30, which is marked by a virtual "+" sign 64.

Figure 2A:
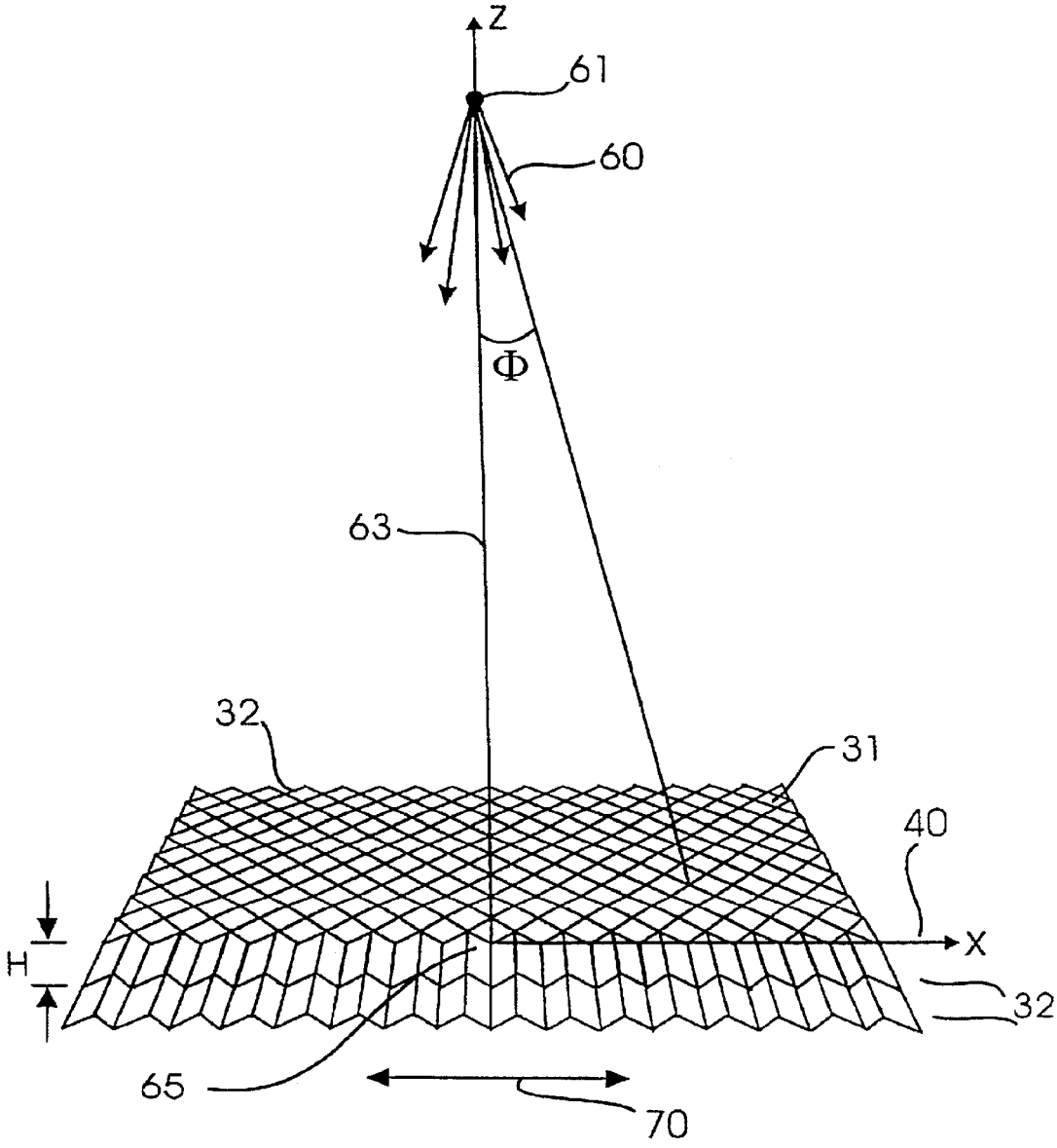
FIG. 2*a* is a schematic of the grid shown in FIG. 1 rotated an angle of 45 degrees with respect to the x and y axes, and being positioned so that the central ray emanates from point x-ray source onto the edge of the grid.
Figure 2B:
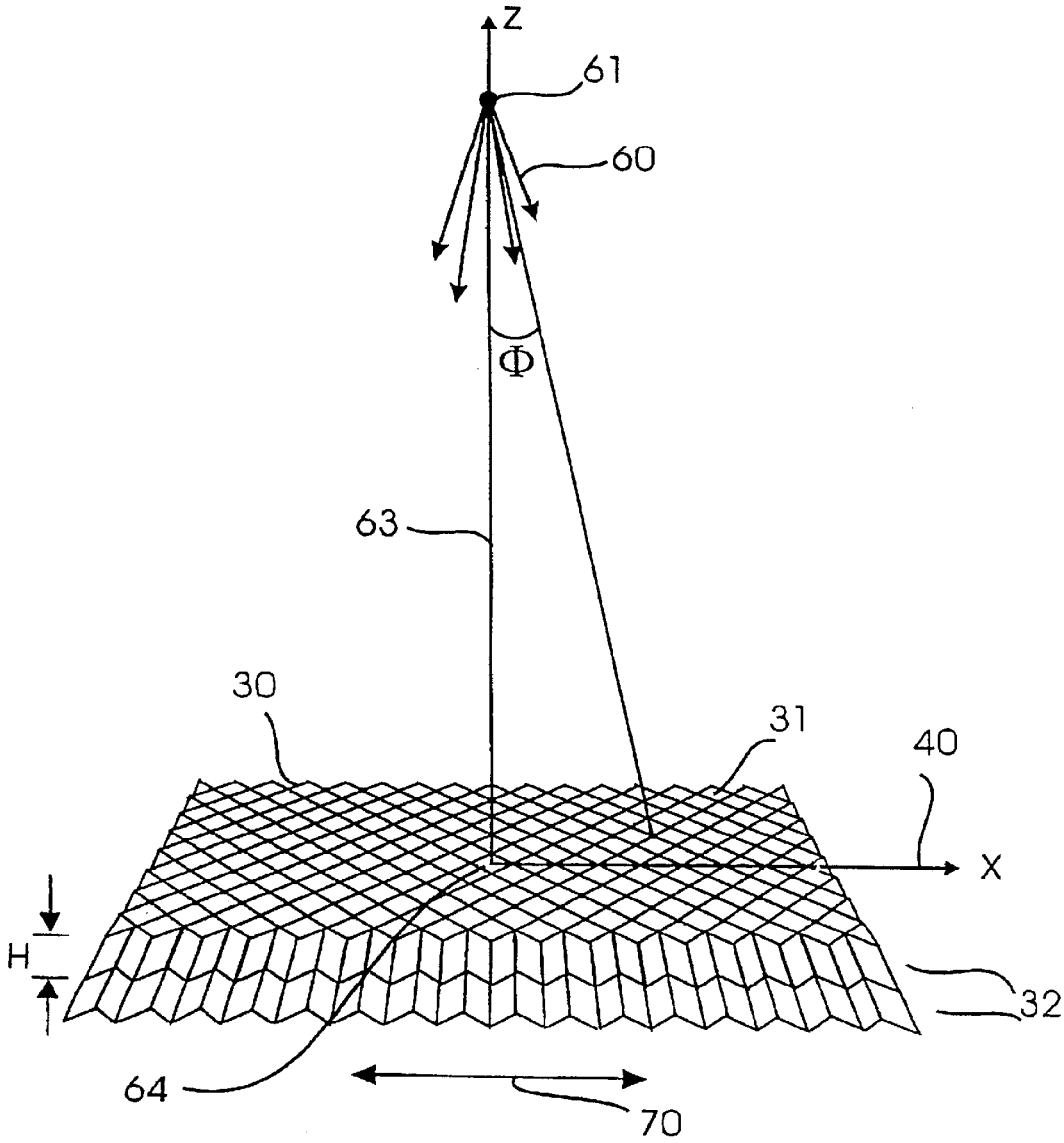
FIG. 2*b* is a schematic of the grid shown in FIG. 1 rotated at an angle of 45 degrees with respect to the x and y axes, and being positioned so that the central ray emanates from point x-ray source onto the center of the grid.

FIGS. 2*a* and 2*b* show schematics of two air-core x-ray anti-scatter grids. such as grid 30 shown in FIG. 1, which are stacked on top of each other in a manner described in more detail below to form a grid assembly. These layers of the grid walls can achieve high aspect ratio such that they are structurally rigid. The stacked grids 30 can be moved steadily along a straight line (e.g., the x-axis 40) during imaging. As shown in these figures, the grids 30 have been oriented so that their walls extend at an angle of 45° or about 45° with respect to the x-axis 50. the top surface of the lop grid 30 is in the x-y plane.

The central ray 63 from the x-ray source 61 is perpendicular or substantially perpendicular to the top surface of the top grid 30. For mammographic applications. the central ray 63 propagates to the top grid 30 next to the chest wall at the edge or close to the edge of the grid on the x-axis 40, which is marked as location 65 in FIG. 2*a*. For general radiology, the central ray 63 is usually at the center of the top grid 30 which is marked as location 64 in FIG. 2*b*. In this example, the line of motion 70 of 30 the grid assembly is parallel or substantially parallel to the x-axis 40. In the x-y plane, one set of the walls 32 (i.e., the septa) is at 45° with respect to the line of motion 70, and the shape of the grid openings 31 is nearly square. The grid assembly can move in just one direction or it can move in both directions in the x-y plane. During motion, the speed at which the grid moves should be constant or substantially constant.

Two categories of grid patterns can be used with linear grid motion to eliminate non-uniform shadow of the grid. The description below pertains to portions of the grid not at the edges of the grid, so the border is not shown. For illustration purposes only, the dimensions of the drawings are not to scale, nor have they been optimized for specific applications.

I. Grid Design Art Type I for Linear Motion

As discussed above, the present invention provides a two-dimensional grid design and a method for moving the grid so that the image taken will leave no substantial artificial images for either focused or unfocused grids for some applications. In particular, as will now be described, the present invention provides methods for constructing grid designs that do not have square patterns. The rules of construction for these grids are discussed below.

Essentially, Type 1 methods for eliminating grid shadows produced by the intersection of the grid walls are based on the assumptions that: (1) there is image blurring during the conversion of x-rays to visible photons or to electrical charge; and/or (2) the resolution of the imaging device is low. A general method of grid design provides a grid pattern that is periodic in both parallel and perpendicular (or substantially parallel and perpendicular) directions to the direction of motion. The construction rules for the different grid variations are discussed below.

Figure 3:
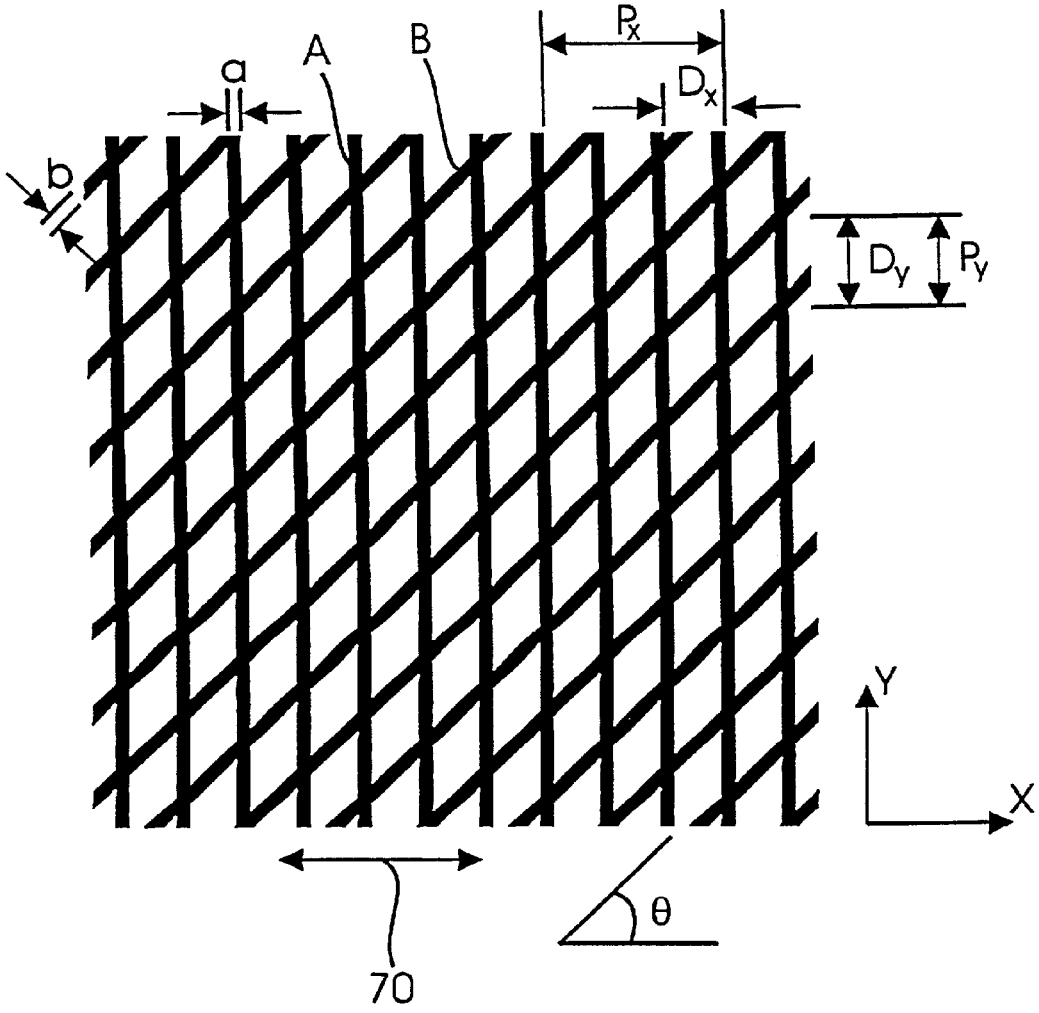
FIG. 3 is an example of a top view of a grid layout as shown in FIG. 1, modified and positioned so that one set of grid walls are perpendicular to a direction of motion along the x-axis and the other set of grid walls is at an angle θ with respect to the direction of motion, thus forming a parallelogram grid pattern applicable for linear grid motion.

Grid Design Variation I. 1: A Set of Parallel Grid Walls Perpendicular to the Line of Motion FIG. 3 shows a top view of an exemplary grid layout that can be employed in a grid 30 as discussed above. The grid layout consists of a set of grid walls, A, that are perpendicular or substantially perpendicular to the direction of motion, and a set of grid walls, B, intersecting A. The thicknesses of grid walls A and B are a and b, respectively. The thicknesses a and b are equal in this figure, but they are not required to be equal. The angle θ is defined as the angle of the grid wall B with respect to the x-axis. The grid moves in the x-direction as indicated by 70. $P_x$ and $P_y$ are the periodicities of the intercepting grid wall pattern in the x- and y-directions, respectively. $D_x$ and $D_y$ represent the pitch of grid cells in the x- and y-directions, respectively.

The periodicity of the grid pattern in the x-direction is $P_x$ $MD_x$, where M is a positive integer greater than 1. The periodicity of the grid pattern in the y-direction is $P_y=M(D_Y/N)$, where N is a positive integer greater than or equal to 1, $M\neq N$ and $P_y=|\tan(\theta)|P_x$. For linear motion, the grid pattern can be generated given $D_x$, (θ or $D_y$), (M or $P_x$) and (N or $P_y$). The parameter range for the angle θ is $0°<|\theta|<90°$. The best values for the angle θ are away from the two end limits, 0° and 90°. The grid intersections are spaced at intervals of $P_y/M$ in the y-direction.

If $D_x$, θ, M and N are given, the parameters $P_x$, $P_y$, and $D_y$ can be calculated FIG. 3 is a plot of a section of the grid for the following chosen parameters: θ=45°, M=3 and N=1.

Figure 4:
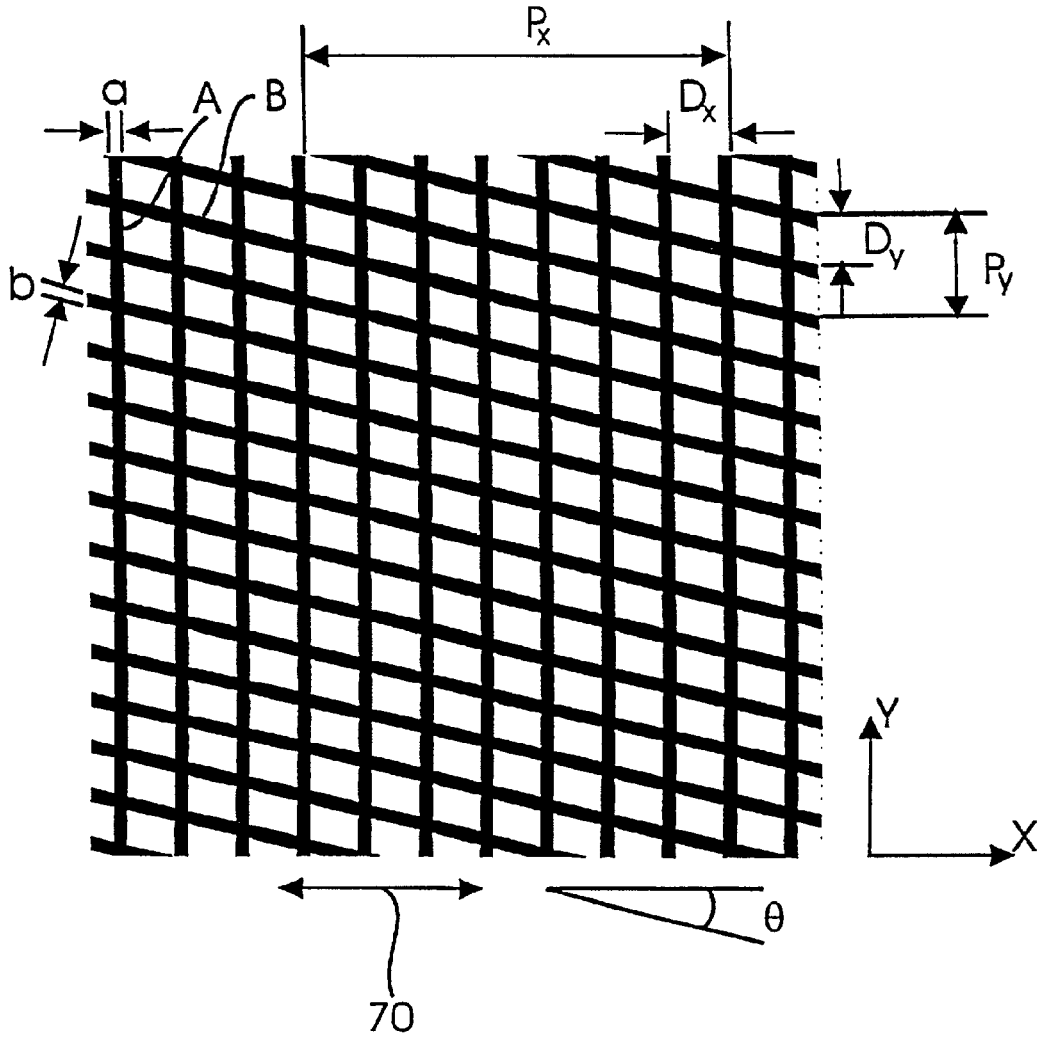
FIG. 4 is an example of a top view of a grid layout as shown in FIG. 1, modified and positioned so that one set of grid walls is perpendicular to the direction of motion along the x-axis and the other set of grid walls makes an angle θ with respect to the direction of motion, thus forming another parallelogram grid pattern applicable for linear grid motion.

If the parameters $D_x$, $D_y$, M and N are chosen, the angle θ , $P_x$ and $P_y$ can be calculated: $P_x=MD_x$, $P_y=ND_y$ and $\theta=\pm a\tan(P_y/P_x)$. FIG. 4 is a plot of a section of the grid for the parameters N=2, M=7 and $\theta=-a\tan(2D_y/7D_x)$.

Grid Design Variation I.2: Grid Walls Not Perpendicular to the Line of Motion

Figure 5:
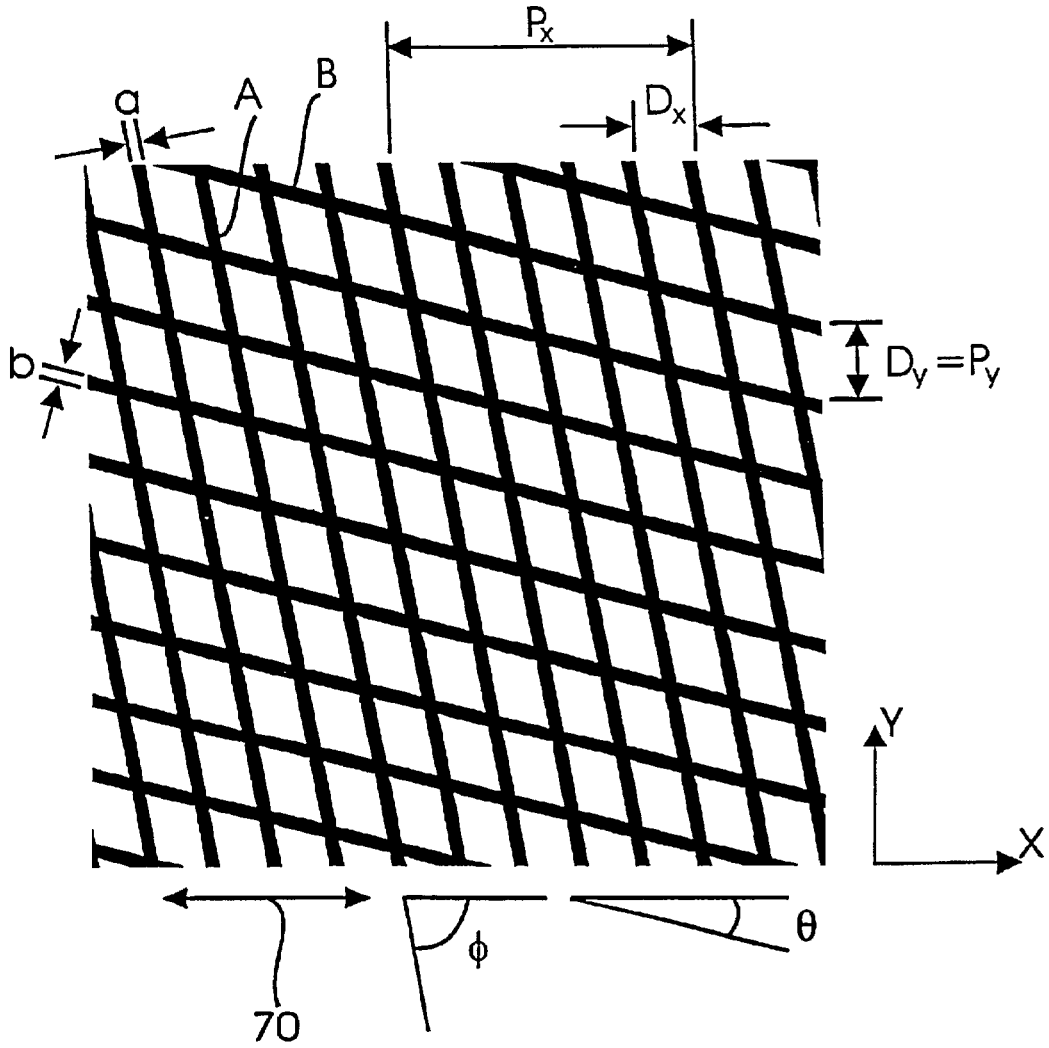
FIG. 5 is an example of a top view of a grid layout as shown in FIG. 1, modified so that the angle of the grid walls are neither parallel nor perpendicular to the direction of grid motion along the x-axis, thus forming a further parallelogram grid pattern applicable for linear grid motion.

FIG. 5 is the top view of a section of the grid layout where neither grid walls A nor B are perpendicular to the direction of linear motion. The thicknesses of grid walls A and B are a and b, respectively. The thicknesses a and b are equal in this figure, but they are not required to be. The angles between the grid walls A and B relative to the x-axis are ϕ and θ, respectively. Choosing $D_x$, (M or $P_x$), (N or $P_y$), and angles (θ or $D_Y$) and ϕ, then $P_y=|\tan(\theta)|P_x$, $N=P_y/D_Y$ and ($M=P_x/D_x$). The centers of grid intersections are separated by a distance $P_y/M$ in the y-direction. FIG. 5 shows an example where θ=−15°, ϕ=−80°, M=5 and N=1.

Figure 6:
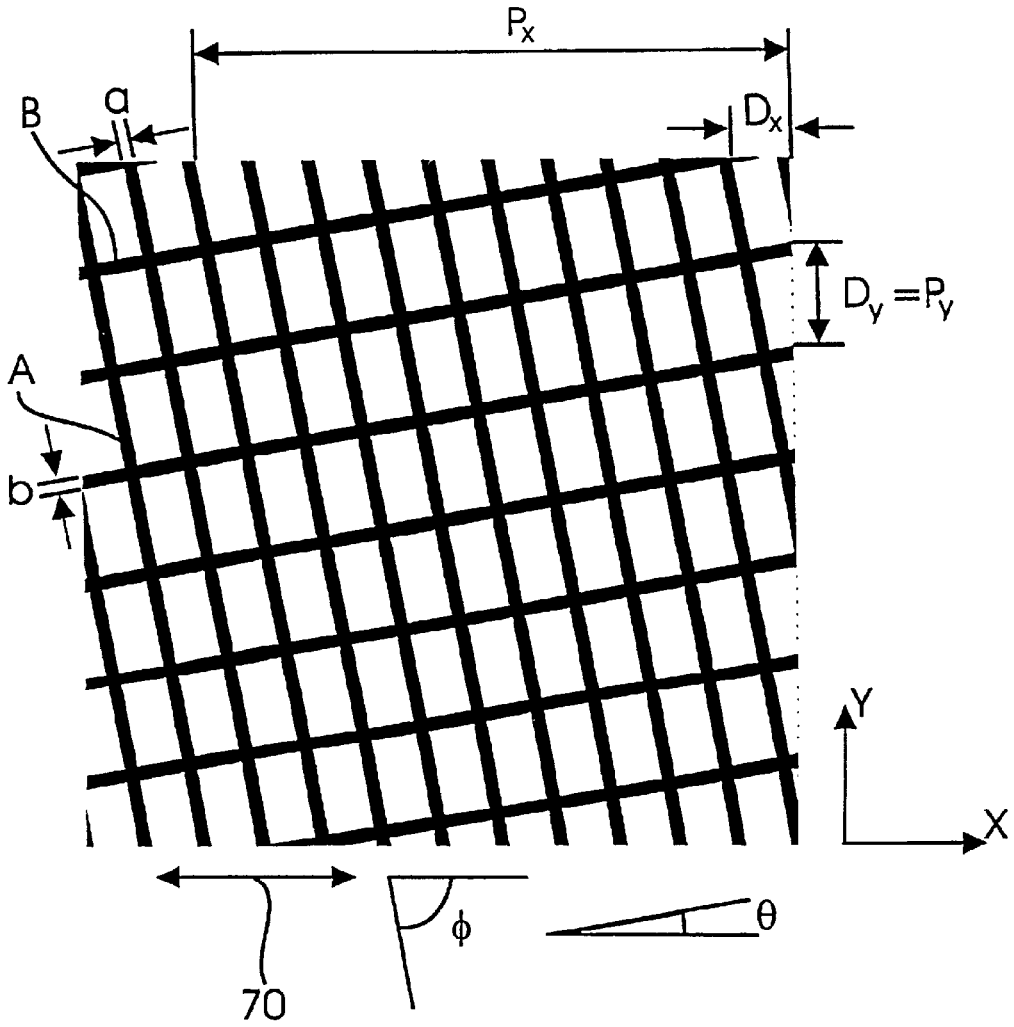
FIG. 6 is a variation of the grid pattern shown in FIG. 5, in which the grid openings are rectangular.

FIG. 6 is the top view of a section of the grid layout where neither grid walls A or B are perpendicular to the direction of motion, but grid wall A is perpendicular to grid wall B, thus a special case of FIG. 5, where the grid openings are rectangular. The thicknesses of grid walls A and B are a and b, respectively. The thicknesses are equal in this figure, but again, they are not required to be equal. The angles between the grid walls A and B relative to the x-axis are ϕ and θ, respectively. By choosing $D_x$, (M or $P_x$), (N or $D_y$), (θ or $P_y$) and ϕ, then $P_y=|\tan(\theta)|P_x$, $P_y=ND_y$, and $P_x=MD_x$. The centers of grid intersections are separated by a distance $P_y/M$ in the y-direction. FIG. 6 shows an example where 0 −10°, ϕ−−80°, M−10 and N=1.

Comments on the Grid Motion Associated with Grid Design I

For all grid layout methods, the range of parameters for the grid can vary depending on many factors, such as film versus digital detectors, the type of phosphor used in film, the type of application, and whether there is direct x-ray conversion or indirect x-ray conversion, etc. The ultimate criteria are that the overexposed strip caused by grid intersections is close enough to each other so that they do not appear in the imaging system.

Some general conditions can be given for the range of parameters for Grid Design Type I and associated motion. It is better for grid openings to be greater than the grid wall thicknesses a and b. For film, $P_y/M$ should be smaller than the x-ray to optical radiation conversion blurring effect produced by the phosphor. For digital imagers with direct x-ray conversion, it is preferable that pixel pitch in the y-direction is an integer multiple of the spacing, $P_y/M$. Otherwise, the grid shadows will be unevenly distributed on the pixels.

The distance of linear travel, L, of the grid during the exposure should be many times the distance $P_x$, where $kP_x>L>(kP_x-\delta L)$, $D_x>\delta L>\alpha\ \sin(\phi)$, $D_x>\delta L>b/\sin(\theta)$, $\delta L/P_x<<1$, $k>>1$, and k is an integer. The ratio of δL/L should be small to minimize the effect of shadows caused by the start and stop. The distance L can be traversed in a steady motion in one direction if it is not too long to affect the transmission of primary radiation. Assuming that the x-ray beam is uniform over time, the speed the grid traverses the distance L should be constant, but the direction can change. In general, the speed at which the grid moves should be proportional to the power of the x-ray source. If the distance L to be traveled in any one direction at the desired speed is too long, causing reduction of primary radiation, then it can be traversed by steady linear motion that reverses direction.

II. Grid Design Type II for Linear Motion

The present invention provides other two-dimensional grid designs and methods of moving the grid such that the x-ray image will have no overexposed strips at the intersection of the grid walls A and B. The principle is based on adding additional cross-sectional areas to the grid to adjust for the increase of the primary radiation caused by the overlapping of the grid walls. These additional cross sectional areas added to the grid, as described in this paragraph and herein, may be referred to as "projections." This grid design and construction provides uniform x-ray exposure.

Two illustrations of the concept are given below, followed by the generalized construction rules. This grid design is feasible for the SLIGA fabrication method described in U.S. Pat. No. 5,949,850 referenced above, because x-ray lithography is accurate to a fraction of a micron even for a thick photoresist.

Grid Design Variation II. 1: Square Grid Shape with an Additional Square Piece

Figure 7:
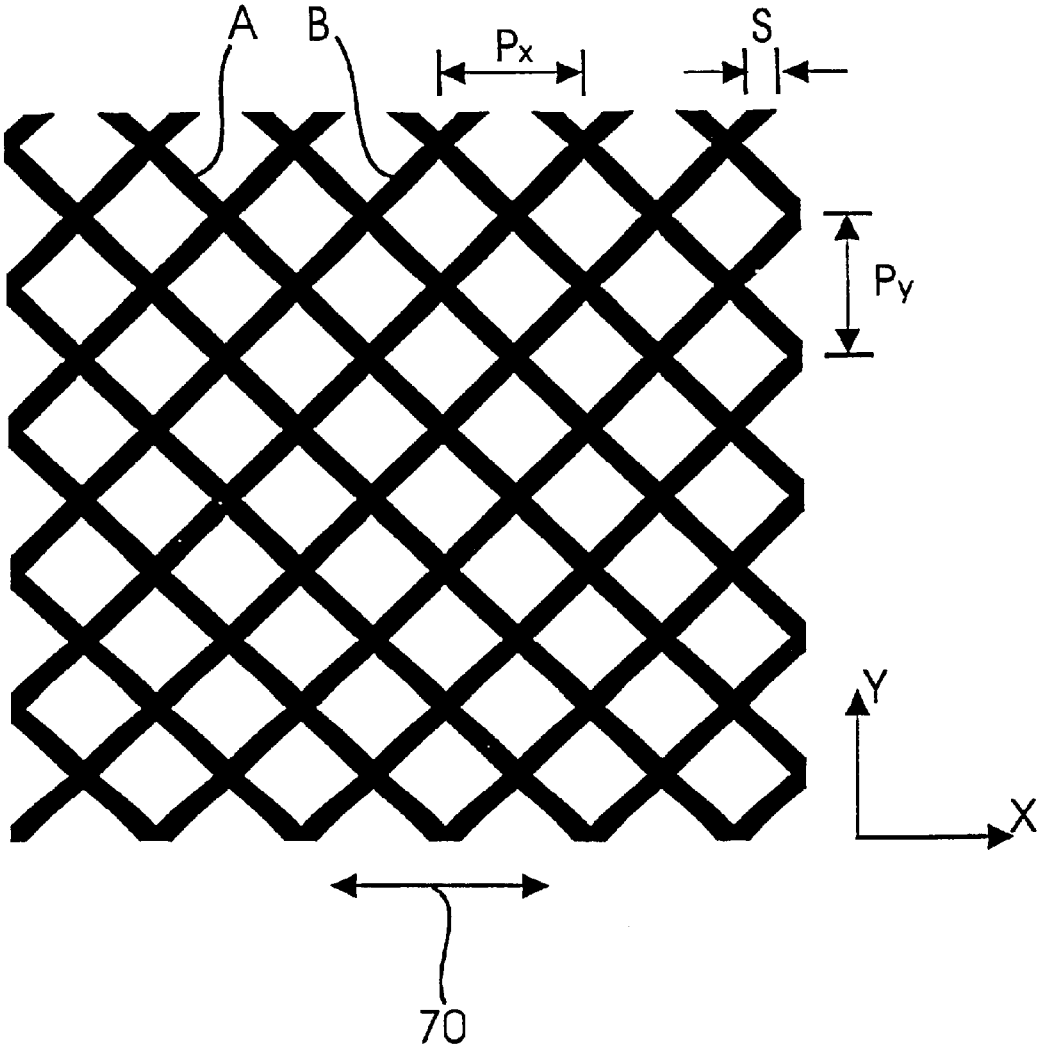
FIG. 7 is a variation of the grid pattern shown in FIG. 5 in which the grid openings are squares.
Figure 8:
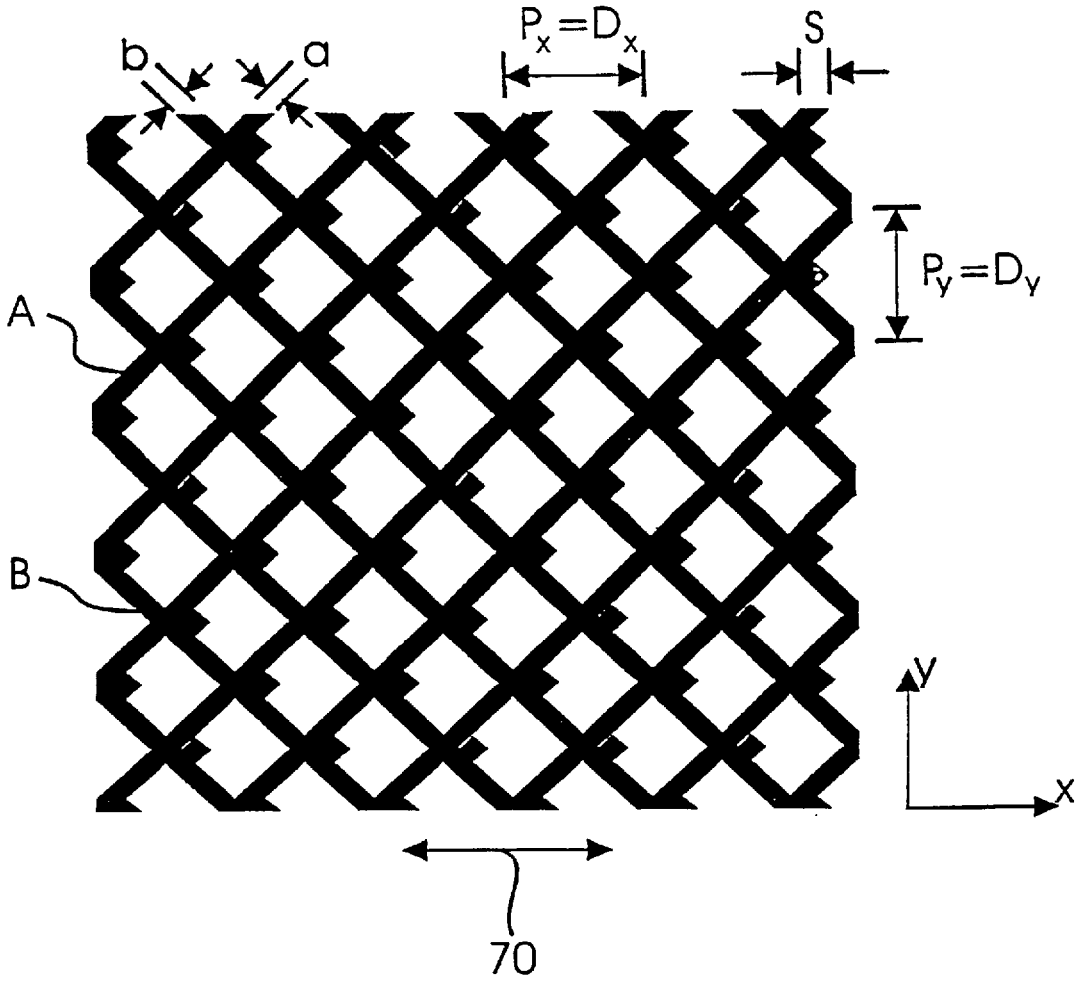
FIG. 8 is a variation of the grid pattern shown in FIG. 5 having modified corners at the wall intersections according to an embodiment of the present invention for eliminating artificial images or shadows on the imager along the direction of linear motion of the grid.

FIG. 7 shows a section of a square patterned grid with uniform grid wall thickness a and b rotated at a 45° angle with respect to the direction of motion. When square pieces in the shape of the septa intersection are added to the grid next to the intersection, with one per intersection as shown in FIG. 8, the grid walls leave no shadow for a grid moving with linear motion 70. In the FIG. 8, $D_x=D_y=P_x=P_y$ and θ=45°. The additional grid area is shown alone in FIG. 9.

Figure 10:
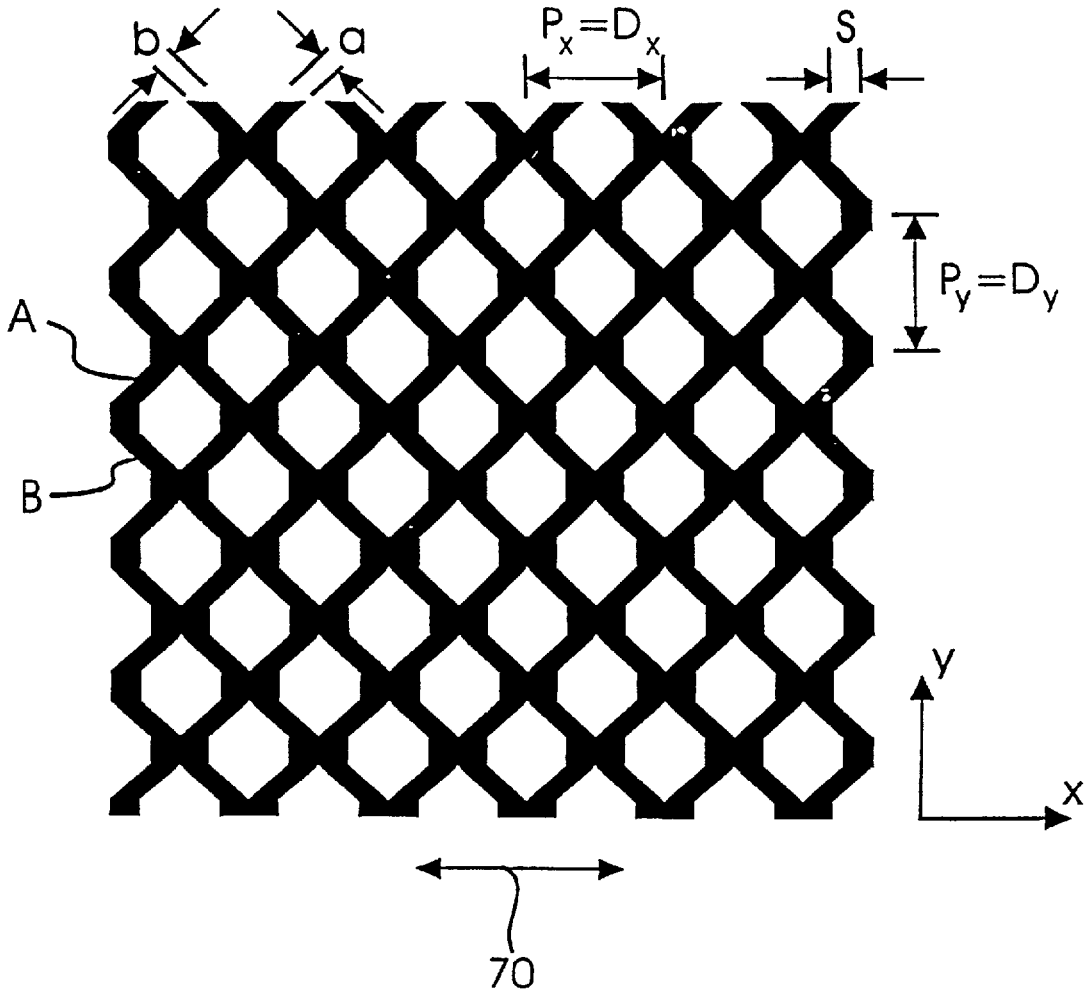
FIG. 10 is the top view of a grid with modified corners at the wall intersections according to another embodiment of the present invention for eliminating artificial images or shadows on the imager along the direction of linear motion of the grid.

Grid Design Variation II.2: Square Grid Shape with Two Additional Triangular Pieces FIG. 10 shows another grid pattern, which has the same or essentially the same effect as the grid pattern in FIG. 8, by placing two additional triangular pieces at opposite sides of intersecting grid walls. In this FIG. 10 example, $D_x=D_y=P_x=P_y$ and $\theta=45°$. The additional grid area is shown alone in FIG. 11.

With these modified corners added to the grid, there will not be any artificial patterns as the grid is moved in a straight line as indicated by 70 for a distance L, where $kD_x>L\geqq(kD_x-\delta L)$, $D_x>>\delta L>s$, $\delta L<<L$, $k>>1$ and k is an integer. Along the x-axis, the grid wall thickness is s and the periodicity of the grid is $P_x=D_x$. The distance of linear travel L should be as large as it can be while keeping the maximum transmission of primary radiation. The condition for linear grid motion in just one direction is easier for grid Design Type II to achieve than grid Design Type I or the designs in U.S. Patents by Pellegrino et al., because $P_x>D_x$ for grid Design Type I.

General Construction Methods for Quadrilateral Grid Design Type II for Linear Motion The exact technique for eliminating the effect of slight overexposure caused by the intersection of the grid walls with linear motion is to add additional grid area at each corner. Two special examples are shown in FIGS. 8 and 10 discussed above, and the general concept is described below and illustrated in FIGS. 12–16. The general rule is that the overlapping grid region C formed by grid walls A and B has to be "added back" to the grid intersecting region, so that the total amount of the wall material of the grid intersected by a line propagating along the x-direction remains constant at any point along the y axis. In other words, the total amount of wall material of the grid intersected by a line propagating in a direction parallel to the x-axis along the edge of a grid of the type shown, for example, in FIG. 8 or 10, is identical to the amount of wall material of the grid intersected by a line propagating in a direction parallel to the x-axis through any position, for example, the center of the grid.

This concept can be applied to any grid layout that is constructed with intersecting grid walls A and B. The widths of the intersecting grid walls do not have to be the same and the intersections do not have to be at 90°, but grid lines cannot be parallel to the x-axis. The width of the parallel walls B do not have to be identical to each other, nor do they need to be equidistant from one another, but they do have to be periodic along the x-axis with period $P_x$. The widths of the parallel lines A do not have to be identical to each other, nor do they need to be equidistant from one another, but they do have to be periodic along the y-axis with period $P_y$.

The generalized construction rules are described using a single intersecting corner of walls A and B for illustration as shown in FIGS. 12–16. The top and bottom corners of parallelogram C are both designated as $\gamma$ and the right and left corners of the parallelogram C as $\beta$1 and $\beta$2, respectively. Dashed lines, f, parallel to the x-axis, the direction of motion, are placed through points $\gamma$. The points where the dashed lines f intersect the edges of the grid lines are designated as $\alpha$1, $\alpha$2, $\alpha$3, and $\alpha$4.

Figure 12:
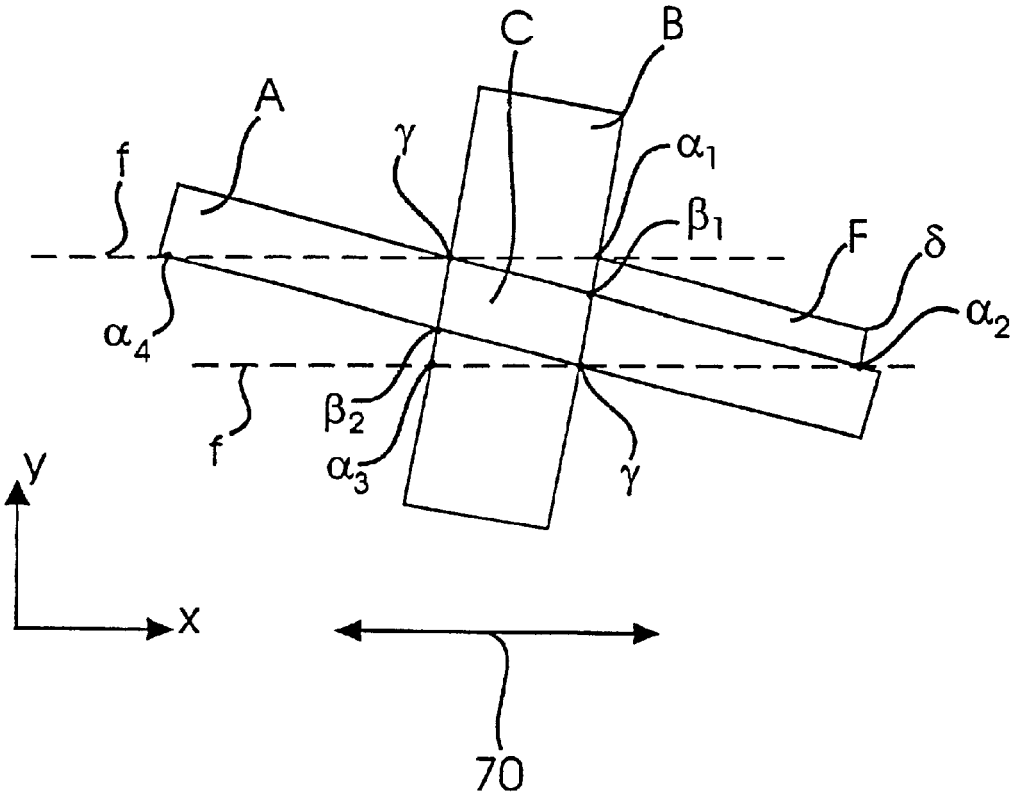
FIG. 12 is a detailed view of a wall intersection of the grid illustrating a general arrangement of an additional grid area that is added to the wall intersection of the grid.

FIG. 12 shows the addition to the grid in the form of a parallelogram F formed by three predefined points: $\alpha$1, $\alpha$2, $\beta$1, and $\delta$, where $\delta$ is the fourth corner. This is the construction method used for the grid pattern shown in FIG. 8.

Figure 13:
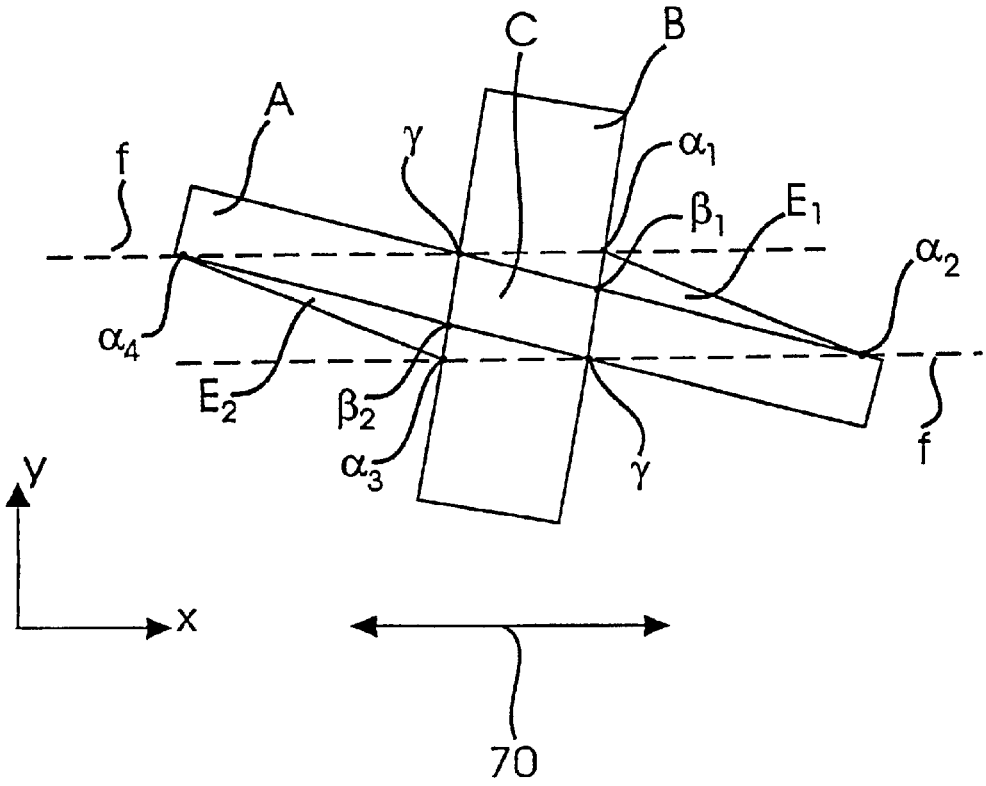
FIG. 13 is a detailed view of a wall intersection of the grid illustrating a general arrangement of an additional grid area that is added to the wall intersection of the grid.

FIG. 13 shows the addition of the grid area in the shape of two triangles, E1 and E2, formed by connecting the points $\alpha$1, $\alpha$2, $\beta$1 and $\alpha$3, $\alpha$4, $\beta$2, respectively. This is the construction method used to make the grid pattern shown in FIG. 10.

Figure 14:
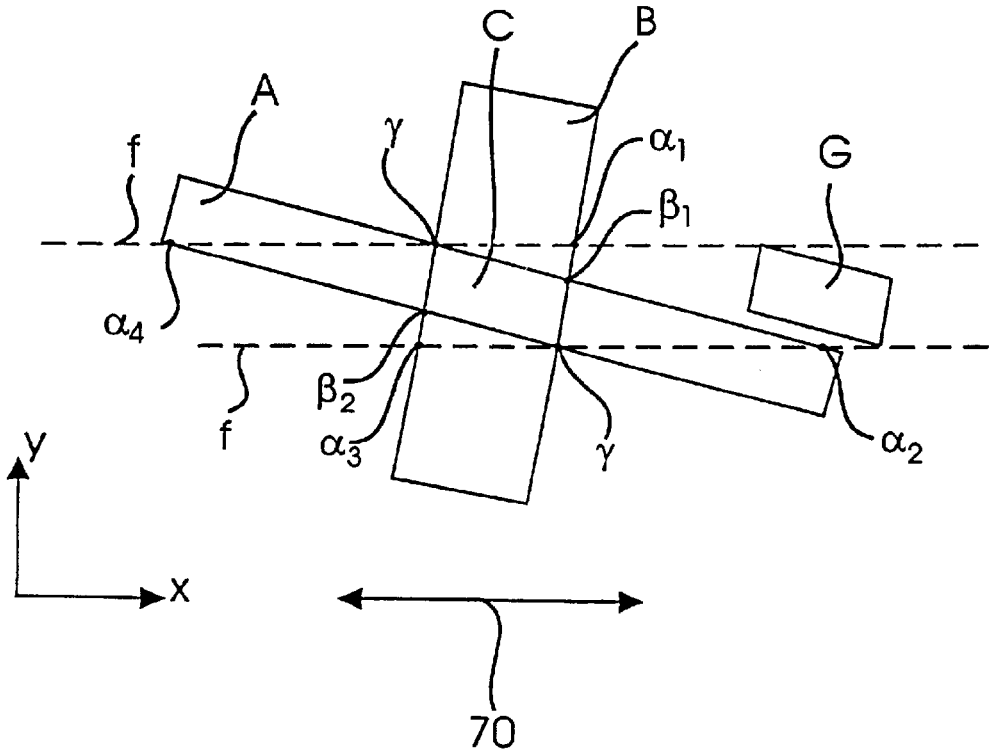
FIG. 14 is a detailed view of a wall intersection of another grid according to an embodiment of the present invention, illustrating a general arrangement of an additional grid area that is added proximate to the wall intersection and not connected to any of the grid walls.
Figure 15:
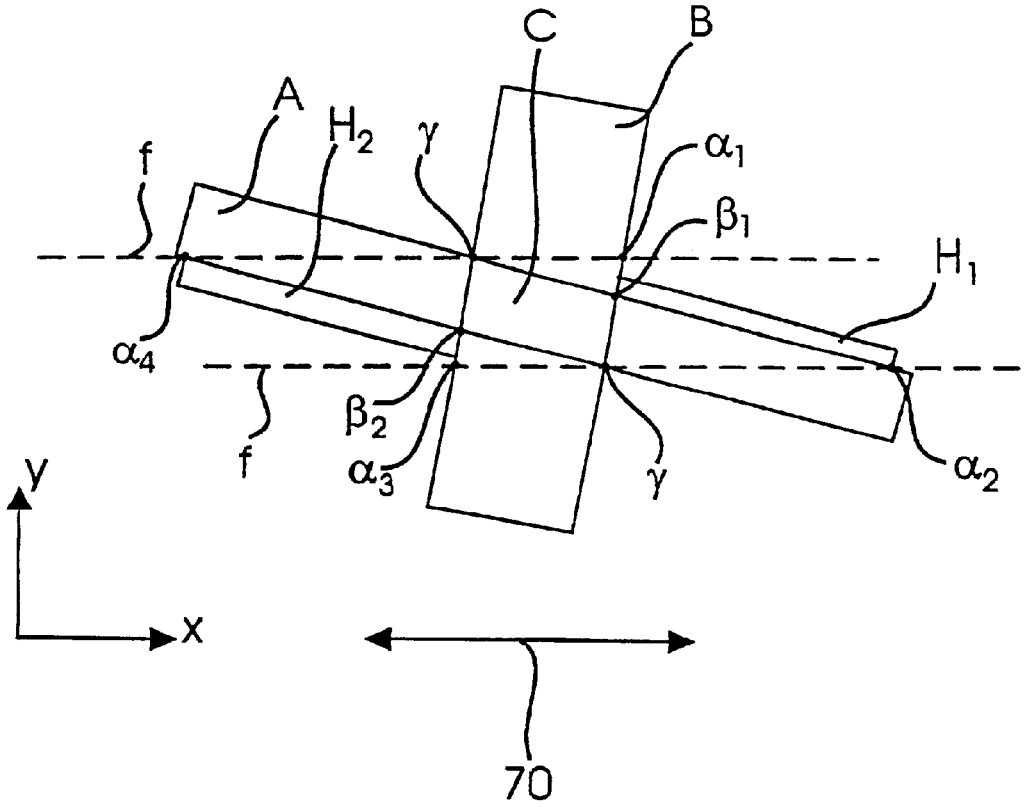
FIG. 15 is a detailed view of a wall intersection of another grid according to an embodiment of the present invention, illustrating a general arrangement of an additional grid area that is added to the wall intersection of the grid, such that two rectangular or substantially rectangular pieces are placed at opposing (non-adjacent) left and right corners of the wall intersection.
Figure 16:
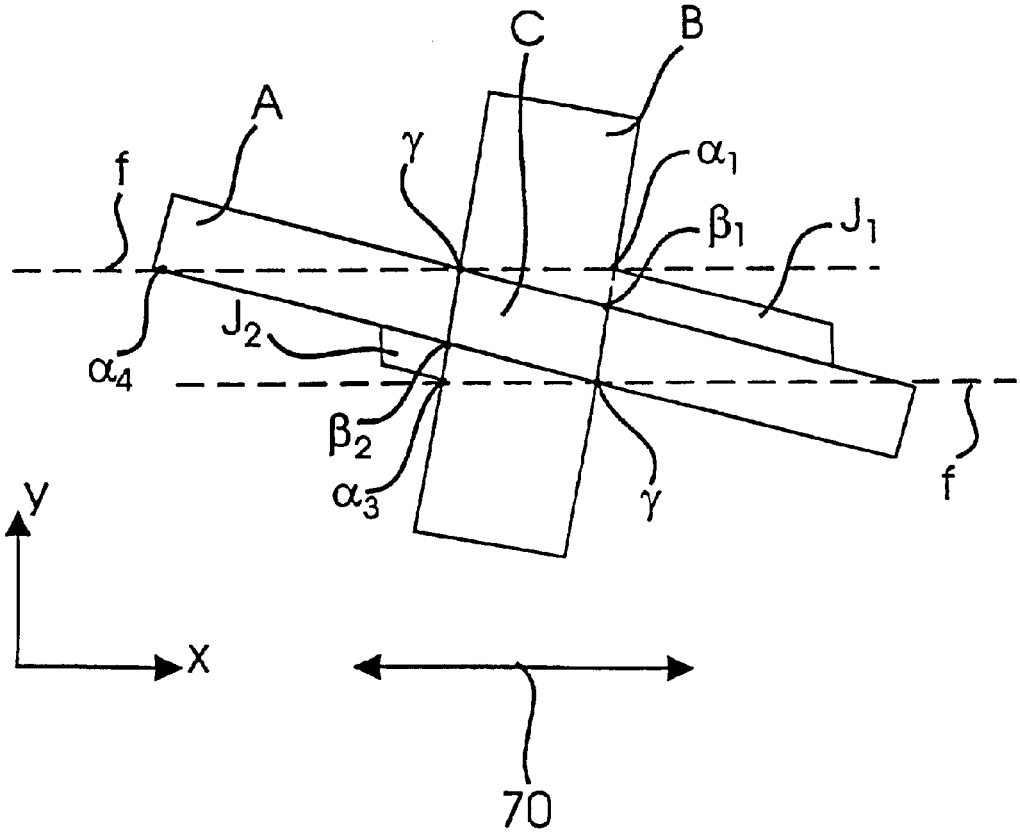
FIG. 16 is a detailed view of a wall intersection of another grid according to an embodiment of the present invention, illustrating a general arrangement of an additional grid area that is added to the wall intersection of the grid, such that two trapezoidal pieces are placed at opposing (non-adjacent) left and right corners of the wall intersection.
Figure 17:
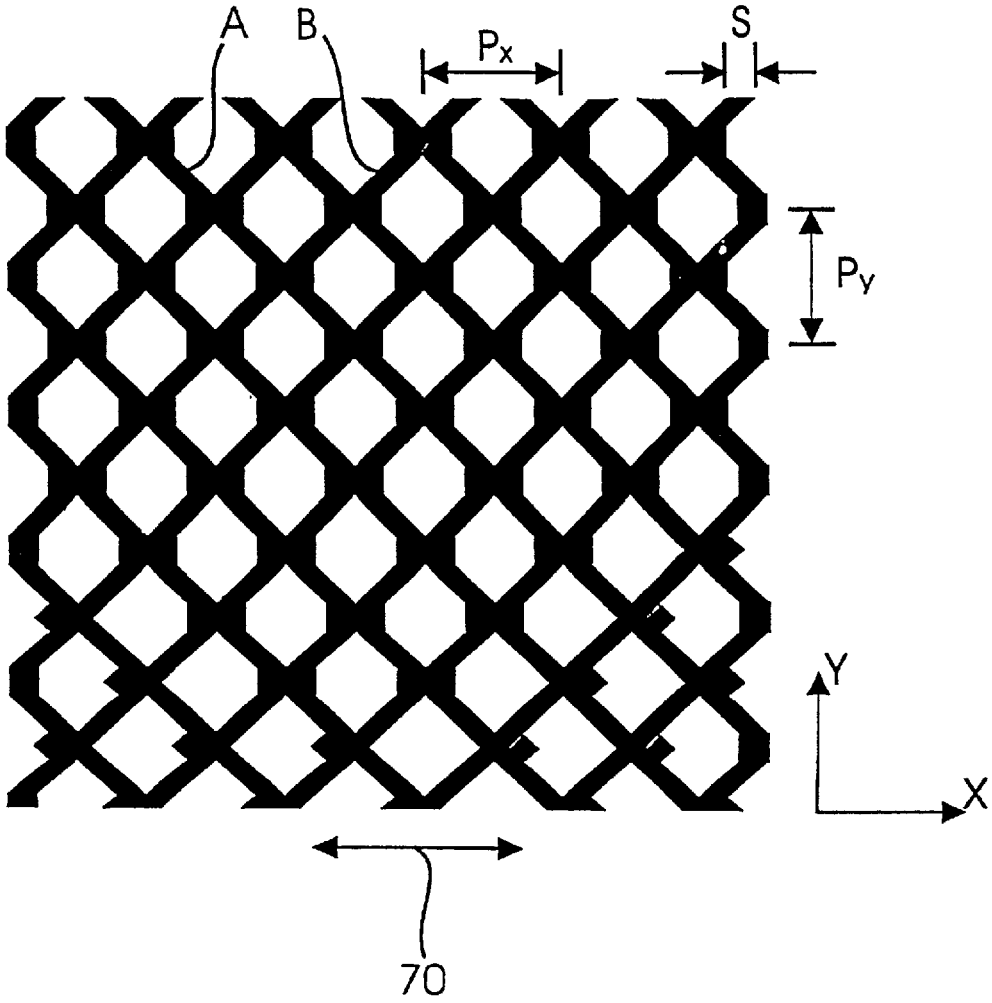
FIG. 17 shows a top view of a portion of a grid according to an embodiment of the present invention, having more than one type of modified corner as shown in FIGS. 12–16.

There are an unlimited variety of shapes that would produce uniform exposure for linear motion. Samples of three other alternatives are shown in FIGS. 14–16. They produce uniform exposure because they satisfy the criteria that the lengths through the grid in the x-direction for any value y are identical. There is no or essentially no difference in performance of the grids if motion is implemented correctly. Additional grid areas of different designs can be mixed on any one grid without visible effect when steady linear motion is implemented. FIG. 17, for example, illustrates and arrangement where different combinations of grid corners are implemented in one grid. However, the choice of grid corners depends on the ease of implementation and practicality. Also, since it is desirable for the transmission of primary radiation to be as large as possible, the grid walls occupy only a small percentage of the cross-sectional area.

General Construction Methods for Grid Design Type II for Linear Grid Motion

It should be first noted that this concept does not limit grid openings to quadrilaterals. Rather, the grid opening shapes could be a wide range of shapes, as long as they are periodic in both x and y directions. The grid wall intercepts do not have to be defined by four straight line segments. Artificial non-uniform shadow will not be introduced as long as the length of the lines through the grid in the x-direction are identical through any y coordinate. In addition to adding the corner pieces, the width of some sections of the grid walls would have to be adjusted for generalized grid openings.

However, not every grid shape that is combined with steady linear motion produces uniform exposure without artificial images. The desirable grid patterns that produce uniform exposure have to satisfy, at a minimum, the following criteria:

- The grid pattern has to be periodic in the direction of motion with periodicity $P_x$,
- No segment of the grid wall is primarily along the direction of the grid motion.
- The grid walls block the x-ray everywhere for the same fraction of the time per spatial period $P_x$ at any position perpendicular to the direction of motion.
- The grid walls do not have to have the same thickness.
- The grid patterns are not limited to quadrilaterals.
- These grid patterns have to be coupled with a steady linear motion such that the distance of the grid motion, L, satisfies the condition described in Sections Grid Design Type I and Type II for Linear Motion.
- If the walls are not continuous at the intersection or not identical in thickness through the intersection, the construction rule that must be maintained is that the length of the line through the grid in the x-direction is identical through any y-coordinate. Hexagons with modified corners are examples in this category.

Implementation of the Grid Design Type II for Linear Grid Motion

The additional grid area at the grid wall intersections can be implemented in a number of ways for focused or unfocused grids to obtain uniform exposure. The discussion will use FIGS. 8 and 10 as examples.

1. The grid patterns with the additional grid area, such as FIGS. 8, 10, 17, and so on, may have approximately the same cross-sectional pattern along the z-axis.
2. Since the additional pieces of the grid are for the adjustment of the primary radiation, these additional grid areas in FIGS. 8, 10, 17, and so on, only have to be high enough to block the primary radiation. This allows new alternatives in implementation.
   - A portion of the grid layer need to have the additional grid area, while the rest of the grid layer do not. For example, a layer of the grid is made with pattern shown in FIG. 8, while the other layers can have the pattern shown in FIG. 7.

The portion of the grid with the shapes shown in FIGS. 8, 10, 17, and so on, can be released from the substrate for assembly or attached to a low atomic weight substrate.

The portion of the grid with the pattern shown in FIGS. 8, 10, 17, and so on, can be made from materials different from the rest of the grid. For example, these layers can be made of higher atomic weight materials, while the rest of the grid can be made from fast electroplating material such as nickel. The high atomic weight material allows these parts to be thinner than if nickel were used. For gold, the height of the grid can be 20 to 50 μm for mammographic applications. The height of the additional grid areas depends on the x-ray energy, the grid material, the application and the tolerances for the transmission of primary radiation.

The photoresist can be left in the grid openings to provide structure support, with little adverse impact on the transmission of primary radiation.

3. The additional grid areas shown in FIGS. 9, 11, and so on, can be fabricated separately from the rest of the grid.

These areas can be fabricated on a low atomic weight substrate and remain attached to the substrate.

These areas can be fabricated along with the assembly posts, which are exemplified in FIGS. 16*a* and 16*b* of U.S. Pat. No. 5,949,850, referenced above.

Figure 9:
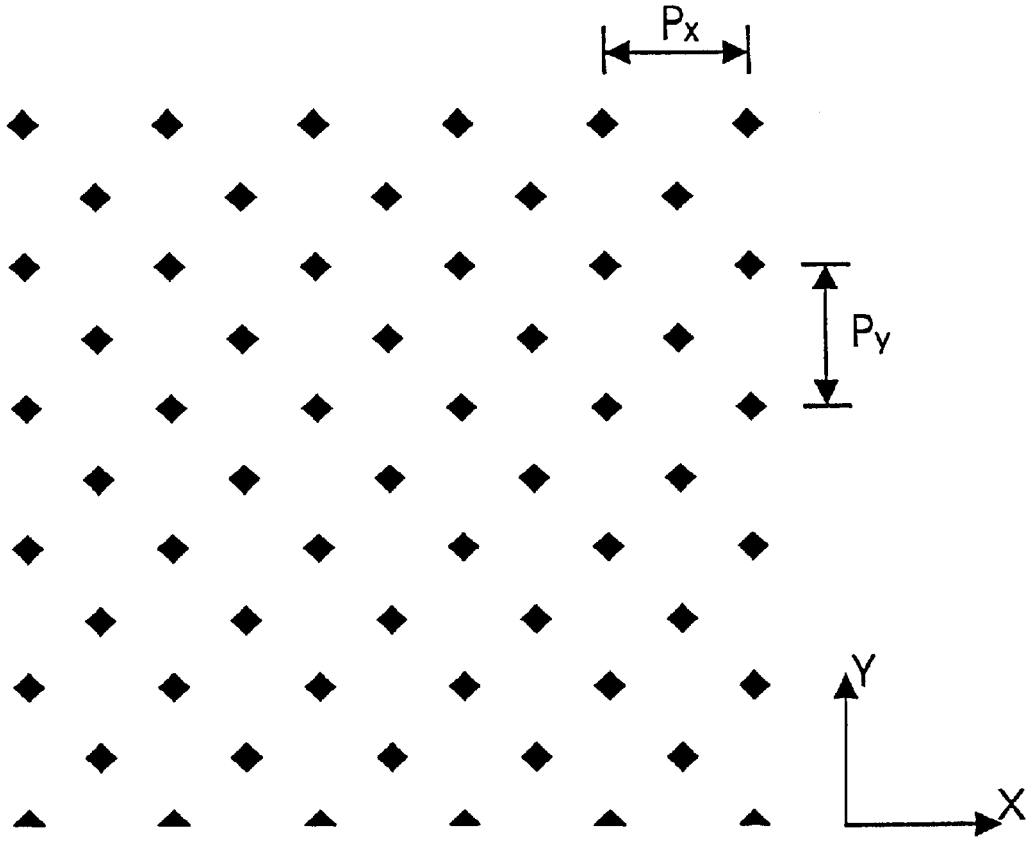
FIG. 9 is the top view of only the additional grid areas that were added to a square grid shown in FIG. 7 to form the grid pattern shown in FIG. 8.
Figure 11:
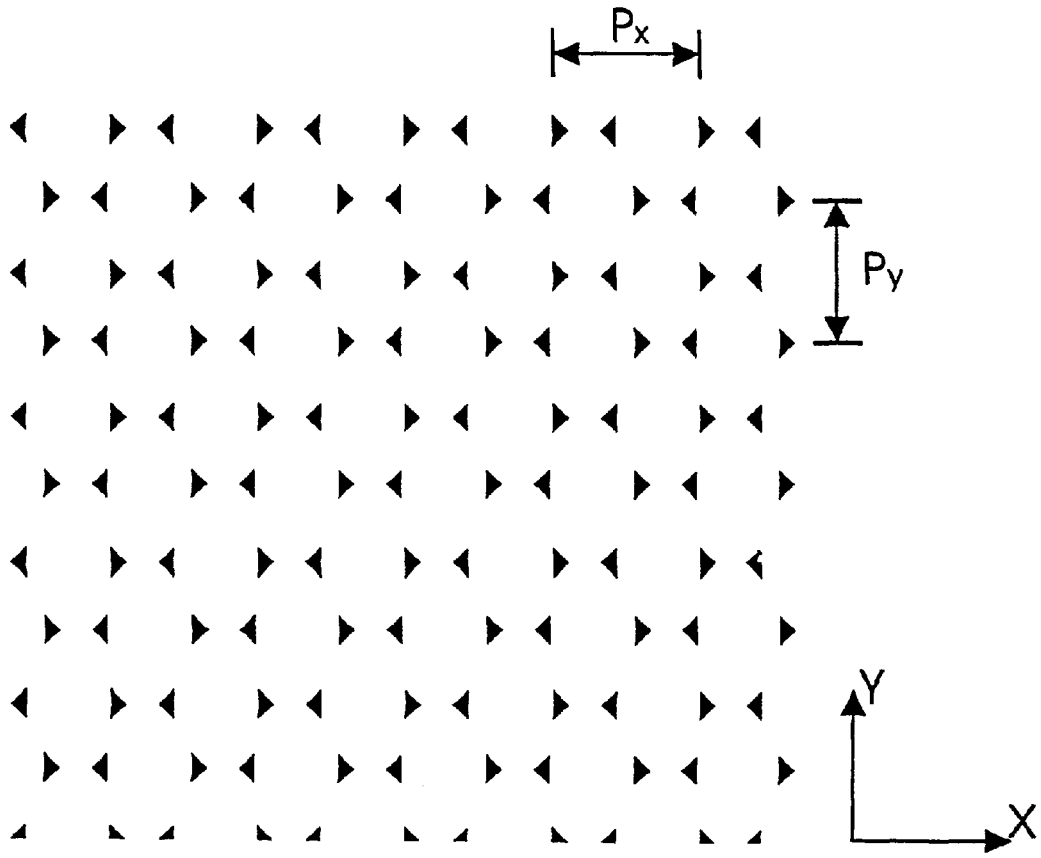
FIG. 11 is a top view of only the additional grid areas that were added to a square grid shown in FIG. 7 to form the grid pattern shown in FIG. 10.

Patterns shown in FIGS. 9, 11, and so on, can be made of a material different from the rest of the grid. For example, these layers can be made from materials with higher atomic weight, while the rest of the grid can be made of nickel. The high atomic weight material allows these parts to be thinner than if nickel were used. For gold, the height of the grid can be 20 to 100 μm for mammographic applications. The height of the additional grid areas depends on the x-ray energy, the grid material, the application and the tolerances for the transmission of primary radiation.

The photoresist can be left on for low atomic weight substrate to provide structure support with little adverse impact on the transmission of primary radiation.

Grid Parameters and Design

Examples of the parameter range for mammography application and definitions are given below. Grid Pitch is $P_x$. Aspect Ratio is the ratio between the height of the absorbing grid wall and the thickness of the absorbing grid wall. Grid Ratio is the ratio between the height of the absorbing wall including all layers and the distance between the absorbing walls.

| | Range | Best case |
|---|---|---|
| Grid Type | Type I or II | Type II/FIG. 10 |
| Grid Opening Shape | Quadrilateral | Square |
| Thickness of Absorbing Wall on the top plane of the grid | 10 μm–200 μm | ≈20–30 μm |
| Grid Pitch for Type I | 1000 μm–5000 μm | |
| Grid Pitch for Type II | 100 μm–2000 μm | ≈300–1000 μm |
| Aspect Ratio for a Layer | 1–100 | >15 |
| Number of Layers | 2–100 | 2–7 |
| Grid Ratio | 3–10 | 5–8 |

However, it should be noted that different parameter ranges are used for different applications, and for different radiation wavelengths.

III. Grid Joint Design

Figure 18:
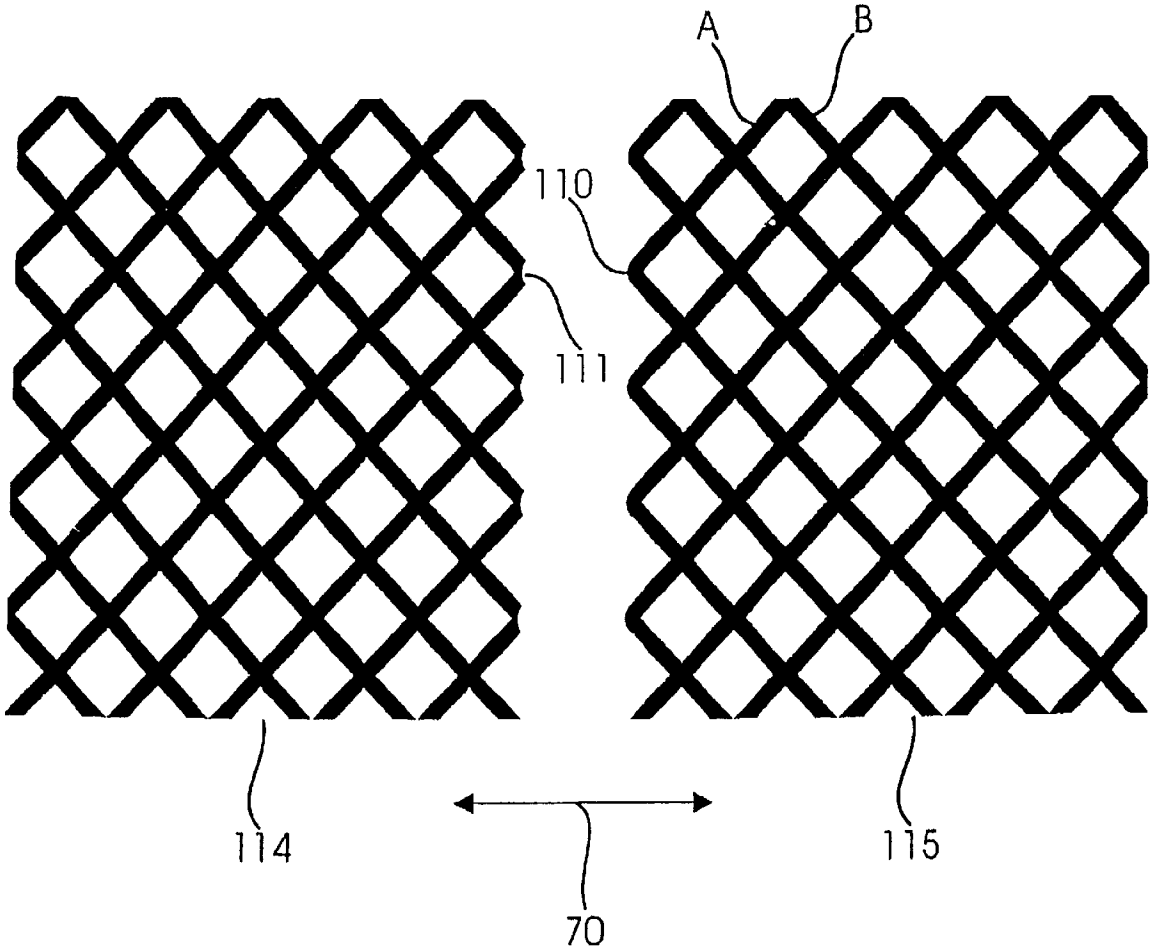
FIG. 18 shows one layer of grid to be assembled from two sections and their joints, using the pattern as shown in FIG. 7.

Designs of grid joints were described in U.S. Pat. No. 5,949,850, referenced. FIG. 18 shows a grid to be assembled from two sections, using the pattern of FIG. 7 as an example. The curved corner interlocks in the shape of 110 and 111 shown in FIG. 18 are found to be more desirable structurally than other grid joints. The details of the corner can vary depending on the implementation of the additional grid structure with motion. Straight line boundaries are also acceptable as long as they retain their relative alignments.

IV. Grid Fabrication

Unfocused grids of any design can be easily fabricated with one mask and a sheet x-ray beam.

When grid size is too large to be made in one piece, sections of grid parts can be made and assembled from a collection of grid pieces. Grids with high grid ratios can be obtained by stacking if they cannot be made the desired thickness in one layer.

Focused grids of any pattern can be fabricated by the method described in U.S. Pat. No. 5,949,850, referenced above. For focused grids for point source, methods for exposing the photoresist using a sheet of parallel x-ray beams are described below.

Grid Design Type I For Linear Motion and Single Piece

If the pattern of the grid in the x-y plane can be made in one piece (not including the border and other assembly parts), the easiest method is to expose the photoresist twice with two masks. The pattern of FIG. 4 is used as an example to assist in the explanation below. This method can be applied to any grid patterns with quadrilateral shapes formed by two intersecting sets of parallel lines.

Figure 19:
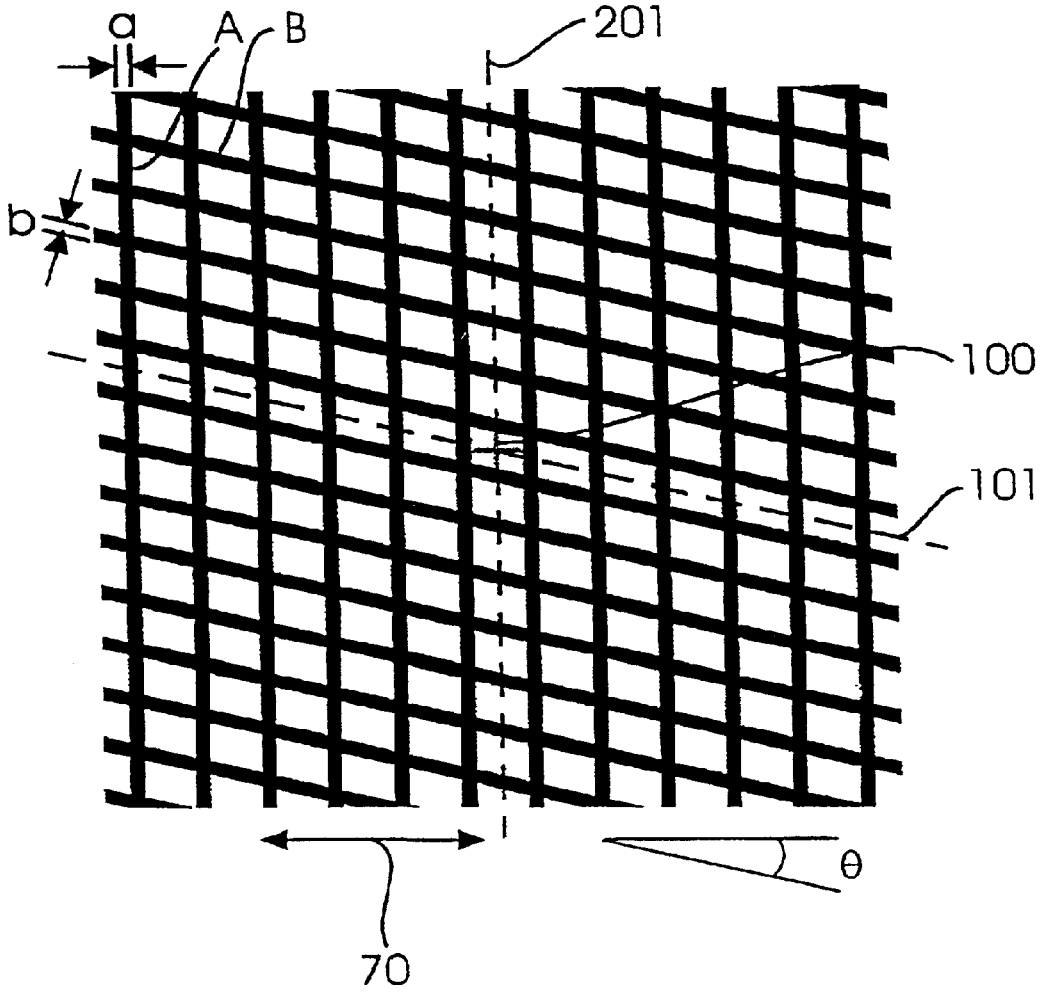
FIG. 19 shows the location of the imaginary central ray and reference lines for photoresists exposures using the grid shape of FIG. 4.
Figure 20A:
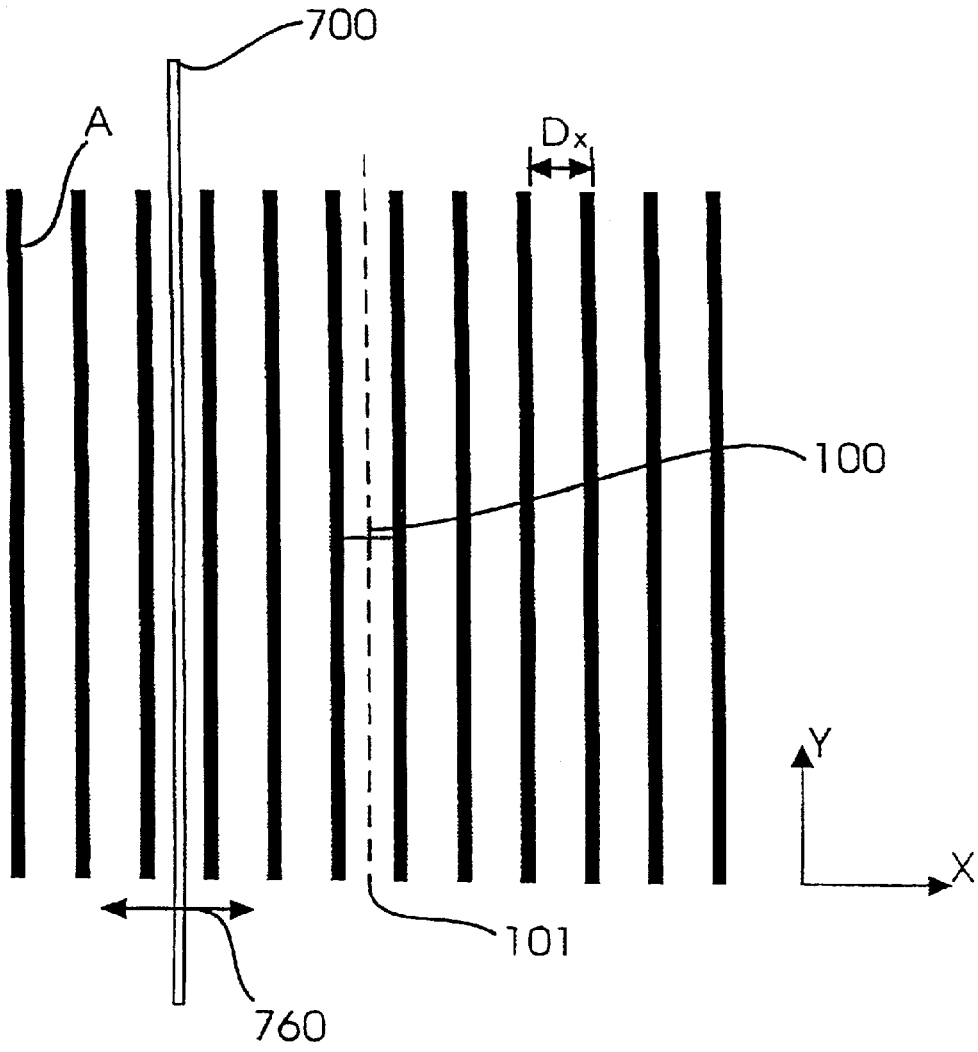
FIGS. 20*a* and 20*b* illustrate exemplary patterns of x-ray masks used to form the grid pattern shown in FIG. 19 according to an embodiment of the present invention.
Figure 20B:
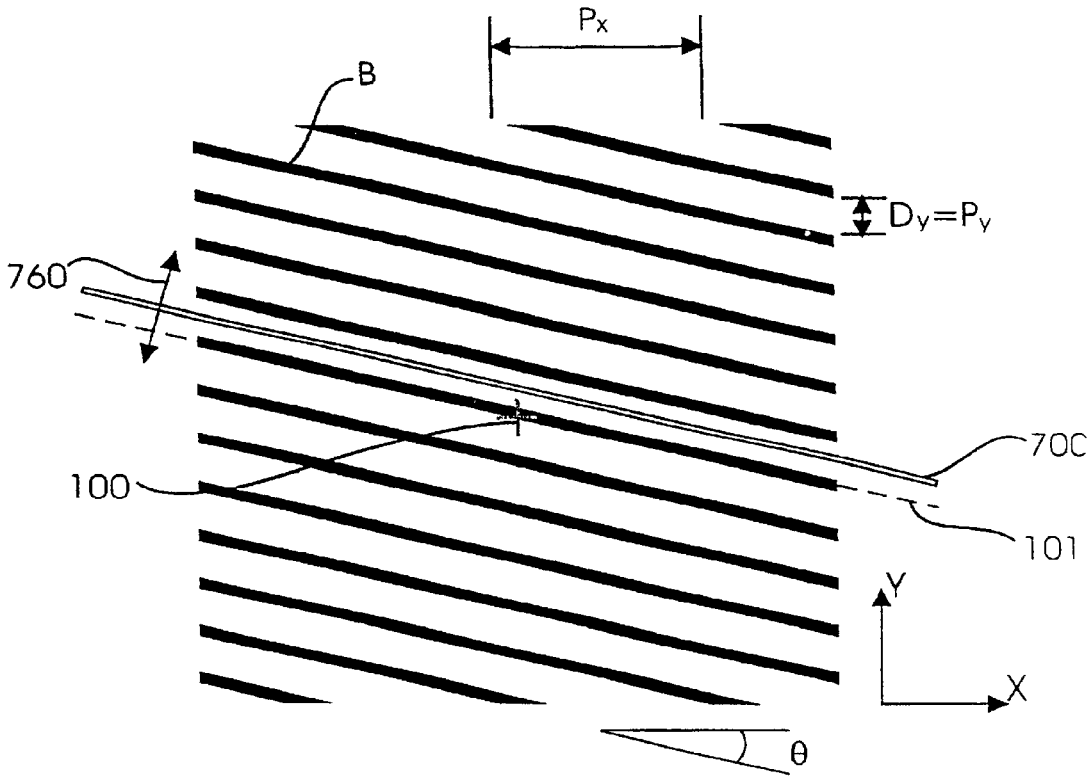
Figure 21:
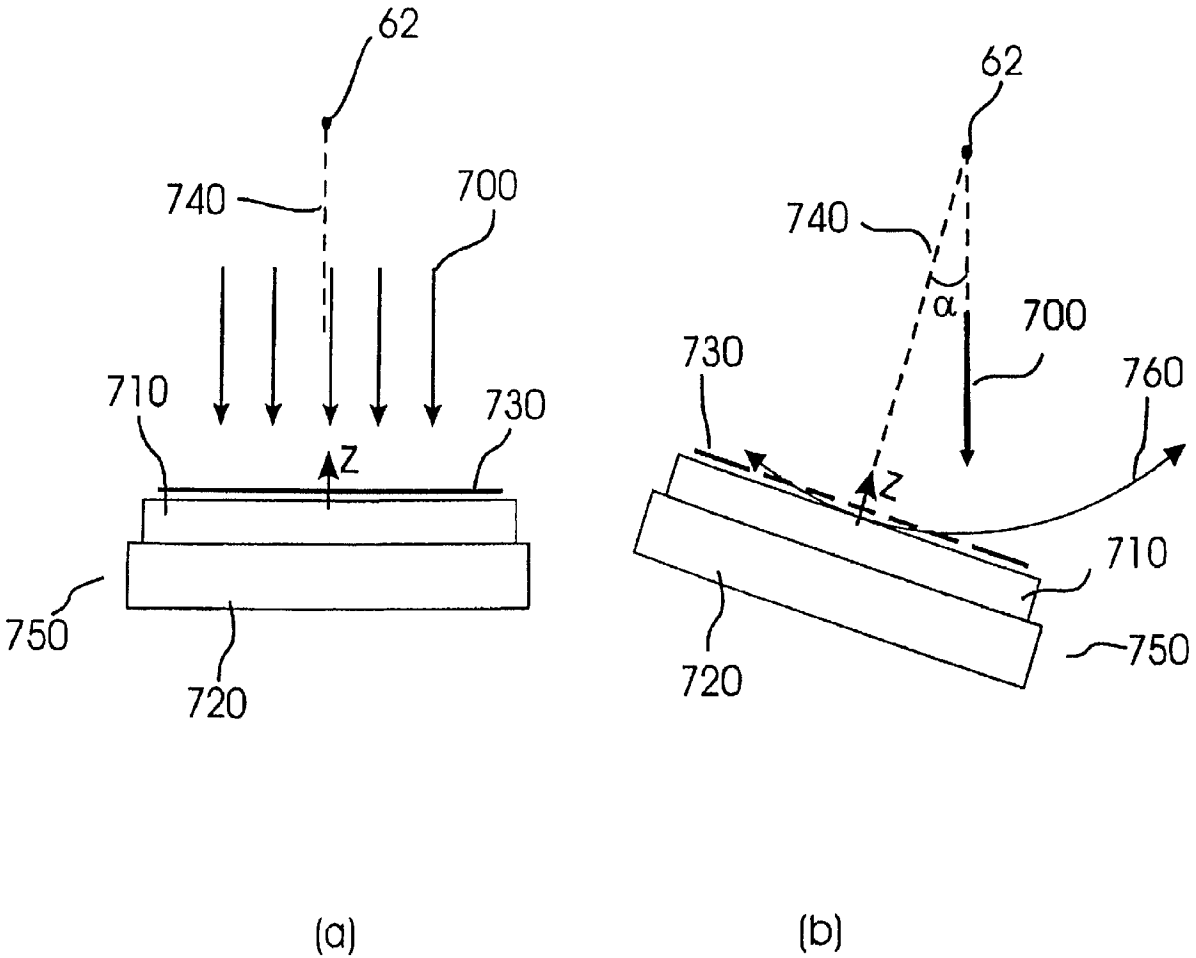
FIGS. 21*a* and 21*b* show an exposure method according to an embodiment of the present invention which uses sheet x-ray beams, such that FIG. 21*a* shows the cross-section in the plane of the sheet x-ray beam
FIG. 21*c* shows another exposure method according to an embodiment of the present invention which uses sheet x-ray beams to form the focusing effect of the grid.

1. For exemplary purposes, the case where the central ray is located at the center of the grid, as shown in FIG. 19, which is marked by a virtual "+" sign 100, will be considered. Two imaginary reference lines 101 are drawn running through the "+" sign, parallel to grid walls A and B.
2. The grid pattern is to be produced by two separate masks. The desired patterns for the two masks are shown in FIG. 20*a* and 20*b*.
3. The photoresist exposure procedure by the sheet x-ray beam is shown in FIGS. 21*a* and 21*b*. For the first exposure, an x-ray mask 730, with pattern shown in FIG. 20*a* or 20*b*, is placed on top of the photoresist 710 and properly aligned, as follows. In FIG. 21*a*, the sheet x-ray beam 700 is oriented in the same plane as the paper, and the reference lines 101 in FIGS. 20*a* or 20*b* of the x-ray masks 730 are parallel to the sheet x-ray beam 700. In FIG. 21*b*, the sheet x-ray beam 700 is oriented perpendicular to the plane of the paper, as are the reference lines of x-ray mask 730. The x-ray mask 730, photoresist 710, and substrate 720 form an assembly 750. The assembly 750 is positioned in such a way that the line 740 that connects the virtual "+" sign 100 with the virtual point x-ray source 62 is perpendicular to the photoresist 710. The angle $\alpha$is 0° when the reference line 101 is in the plane of the x-ray source 700. To obtain the focusing effect in the photoresist 710 by the sheet x-ray beam 700, the assembly 750 rotates around the virtual point x-ray source 62 in a circular arc 760. This method will produce focused grids with opening that are focused to a virtual point above the substrate.

Figure 21C:
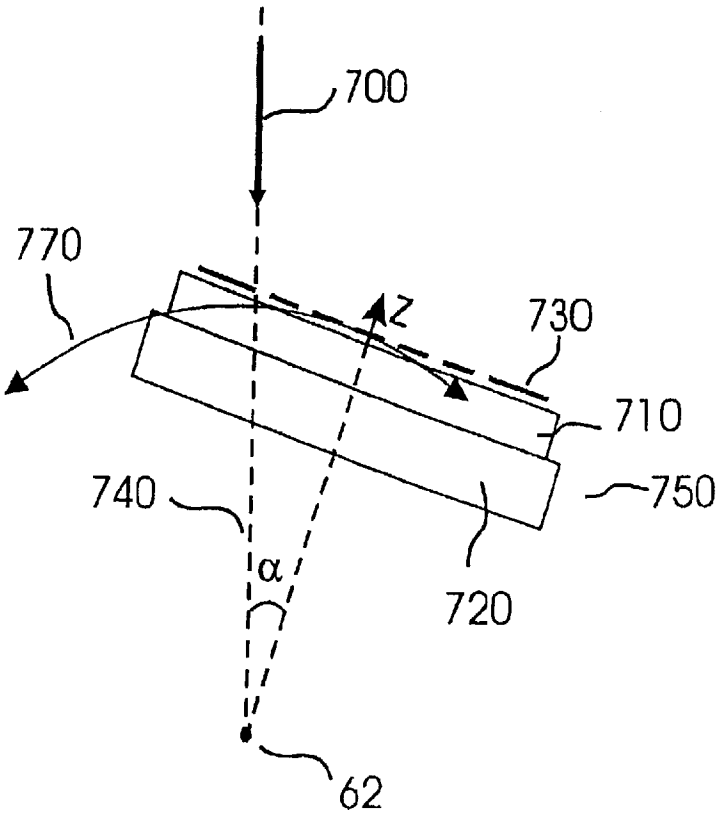

There are situations that one would like to produce a layer of the grid with that are focused to a virtual point below the substrate as shown in FIG. 21*c*. In FIG. 21*c*, the sheet x-ray beam 700 is oriented perpendicular to the plane of the paper, as are the reference lines of x-ray mask 730. The assembly 750 is positioned in such a way that the line 740 that connects the virtual "+" sign 100 with the virtual point x-ray source 62 is perpendicular to the photoresist 710. The angle α is 0° when the reference line 101 is in the plane of the x-ray source 700. To obtain the focusing effect in the photoresist 710 by the sheet x-ray beam 700, the assembly 750 rotates around the virtual point x-ray source 62 in a circular arc 770.

Figure 22:
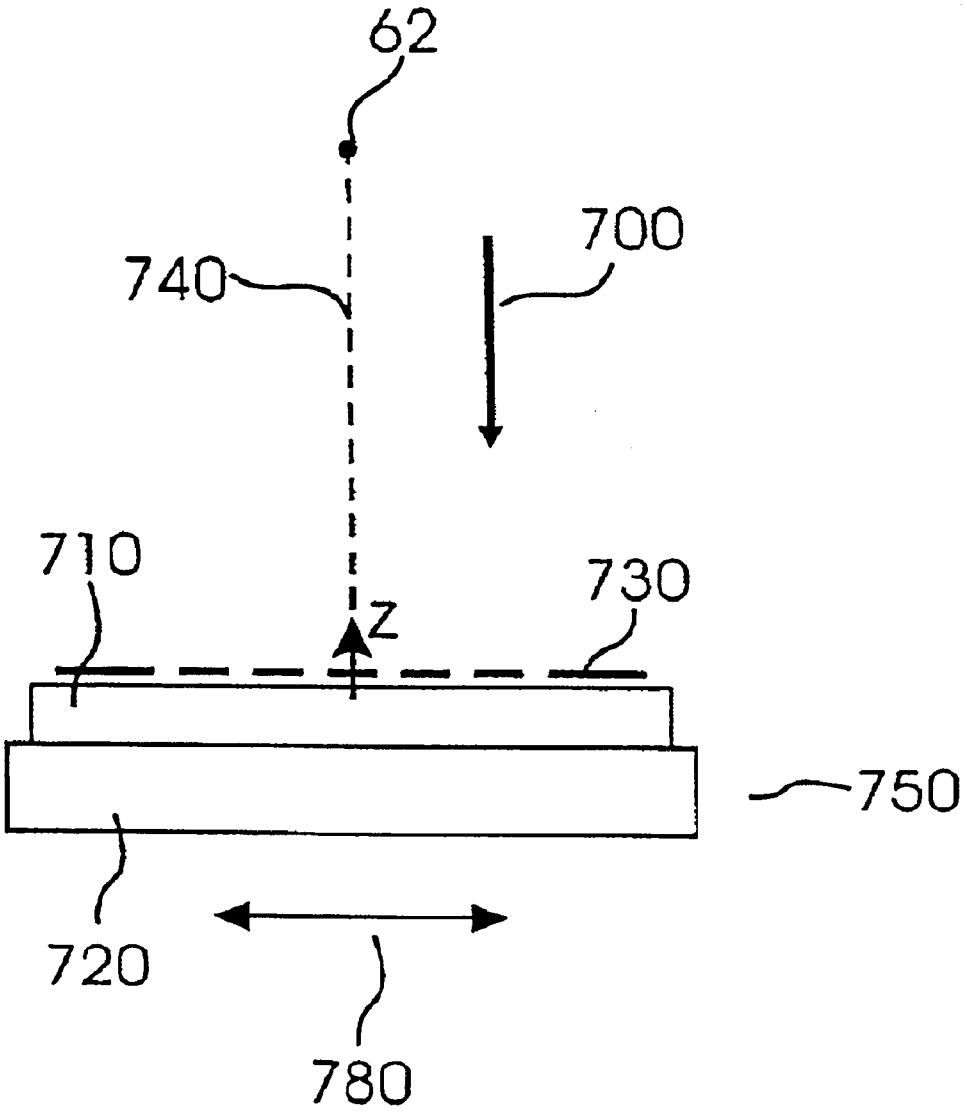
FIG. 22 shows an exposure method according to an embodiment of the present invention which is used in place of the method shown in FIG. 21*b* for exposing grids or portions of grids where the walls, joints or holes are not focused.

4. For the second exposure, the second x-ray mask is properly aligned with the photoresist 710 and the substrate 720. The exposure method is the same as in FIGS. 21*a* and 21*b* or 21*c*.
5. To facilitate assembly, a border is desirable. The border can be part of FIG. 20*a* or 20*b*; or it can use a third mask. The grid border mask should be aligned with the photoresist 710 and its exposure consists of moving the assembly 750 such that the sheet x-ray beam 700 always remains perpendicular to the photoresist 710, as shown in FIG. 22. The assembly 750 moves along a direction 780.
6. The rest of the fabrication steps are the same as in described in U.S. Pat. No. 5,949,850, referenced above.

Grid Design Type I For Linear Motion and Multiple Pieces Joint Together per Layer If two or more pieces of the grid are required to make a large grid, the grid exposure becomes more complicated. In that case, at least three masks will be required to obtain precise alignment of grid pieces.

Figure 23:
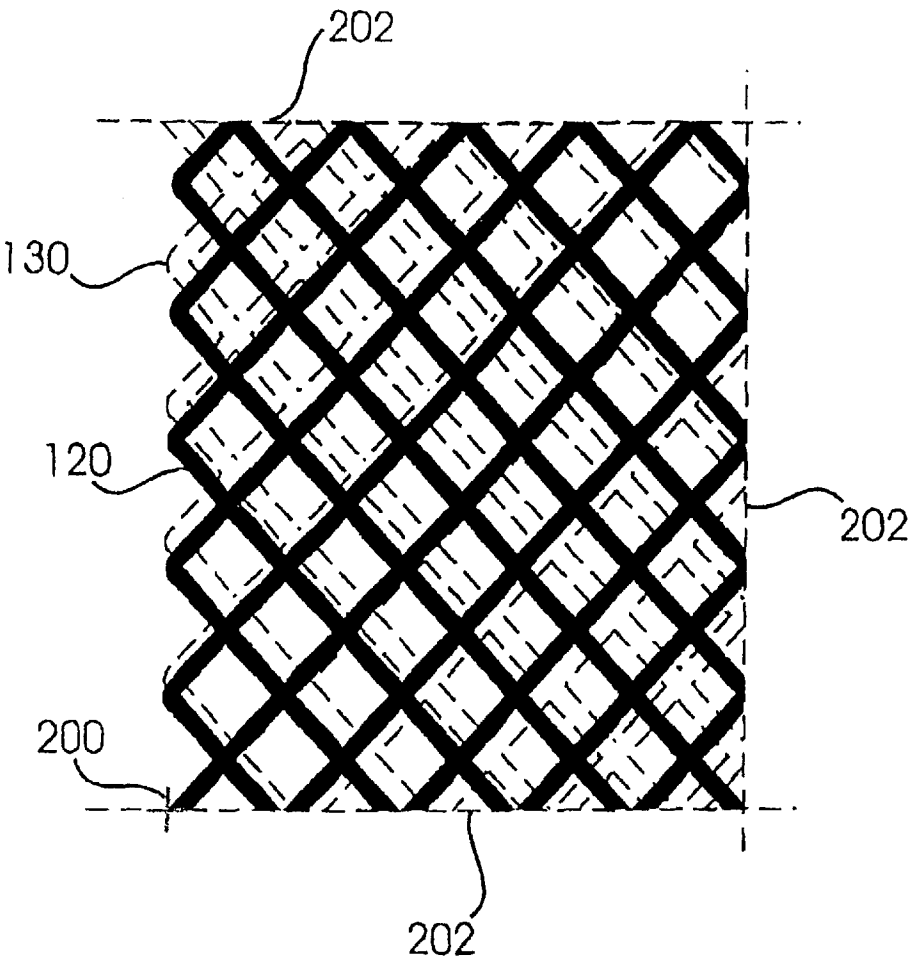
FIG. 23 shows an example the top and bottom patterns of the exposed photoresists exposed according to the methods shown in FIGS. 21*a* and 21*b;*

The desired exposure of the photoresist is shown in FIG. 23, using pattern 115 shown on the right-hand-side of FIG. 18 as an example. The effect of the exposure on the photoresist outside the dashed lines 202 is not shown. The desirable exposure patterns are the black lines 120 for one surface of the photoresist, and are the dotted lines 130 for the other surface. The location of the central x-ray is marked by the virtual "+" sign at 200. The shape of the left border is preserved and all locations of the grid wall are exposed.

Figure 24:
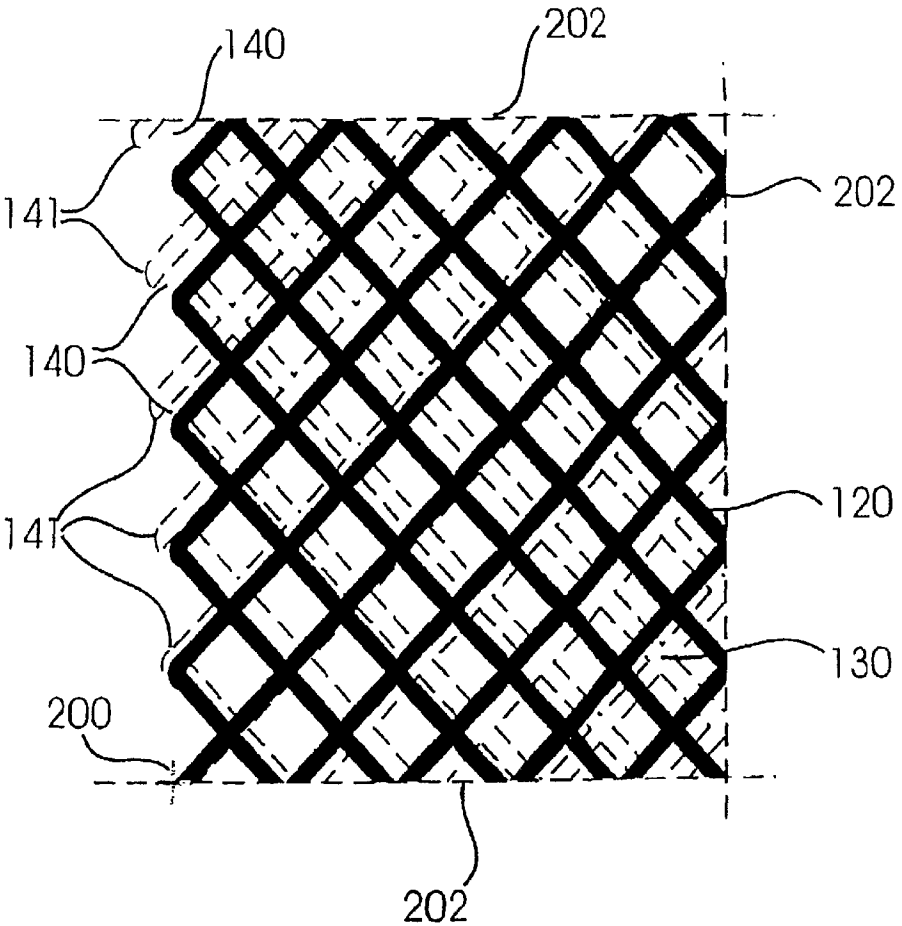
FIG. 24 shows an example of the top and bottom patterns of an incorrectly exposed photoresists which was exposed using only two masks and a sheet x-ray beam.

Although the procedures discussed above with regard to FIGS. 21*a* and 21*b* are generally sufficient to obtain the correct exposure near the grid joint using two masks, one for wall A and one for wall B, incorrect exposure may occur from time to time. This problem is illustrated in FIG. 24. The masks are made so as to obtain correct photoresist exposure at the surface of the photoresist next to the mask. The dotted lines 130 denote the pattern of the exposure on the other surface of the photoresist. Some portions of the photoresist will not be exposed 140, but other portions that are exposed 141 should not be. The effect of the exposure on the photoresist outside the dashed lines 202 is not shown.

Figure 25A:
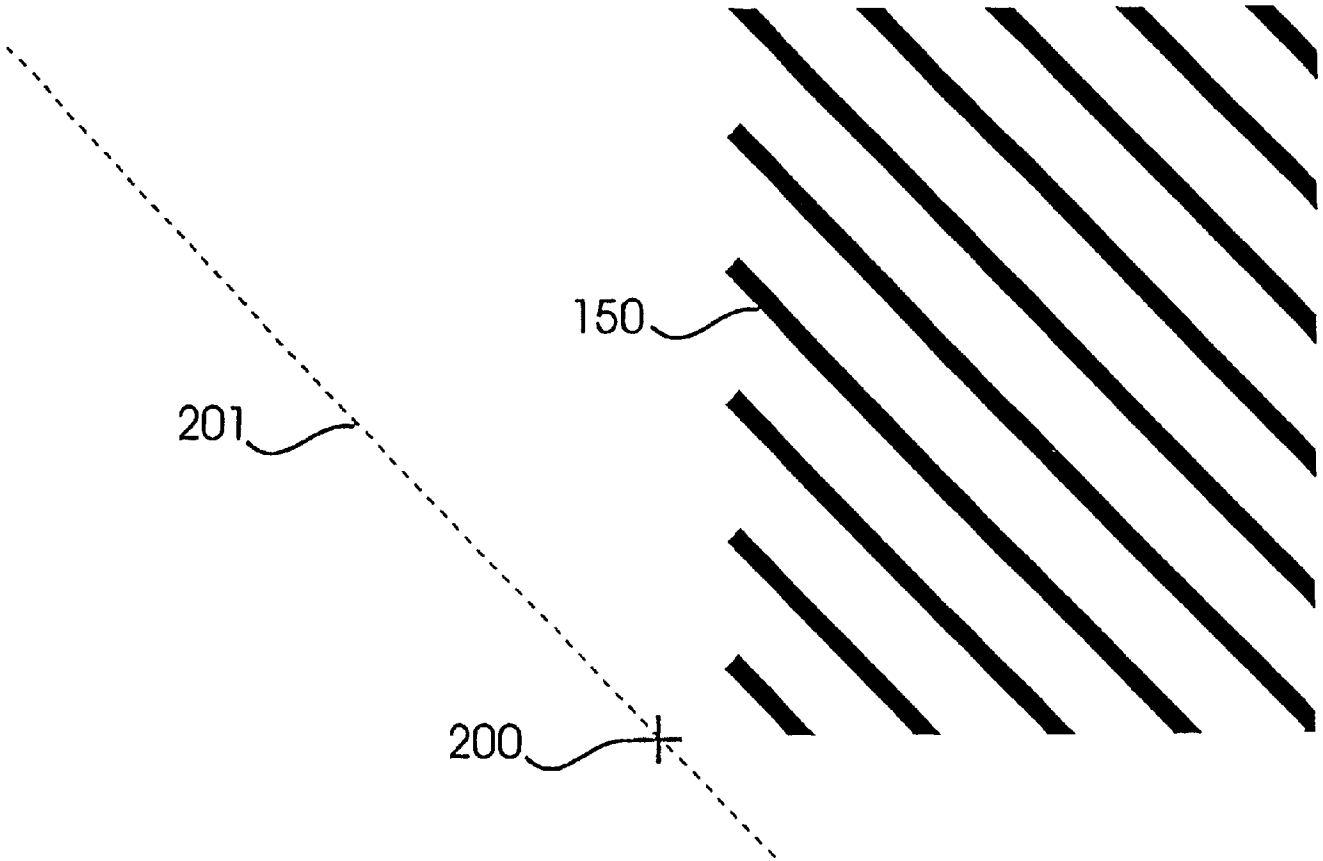
FIGS. 25*a* and 25*b* show an example of x-ray masks used to expose the central portion of right-hand-side of a focused grid shown in FIG. 18 using a sheet x-ray beam according to an embodiment of the present invention.
Figure 25B:
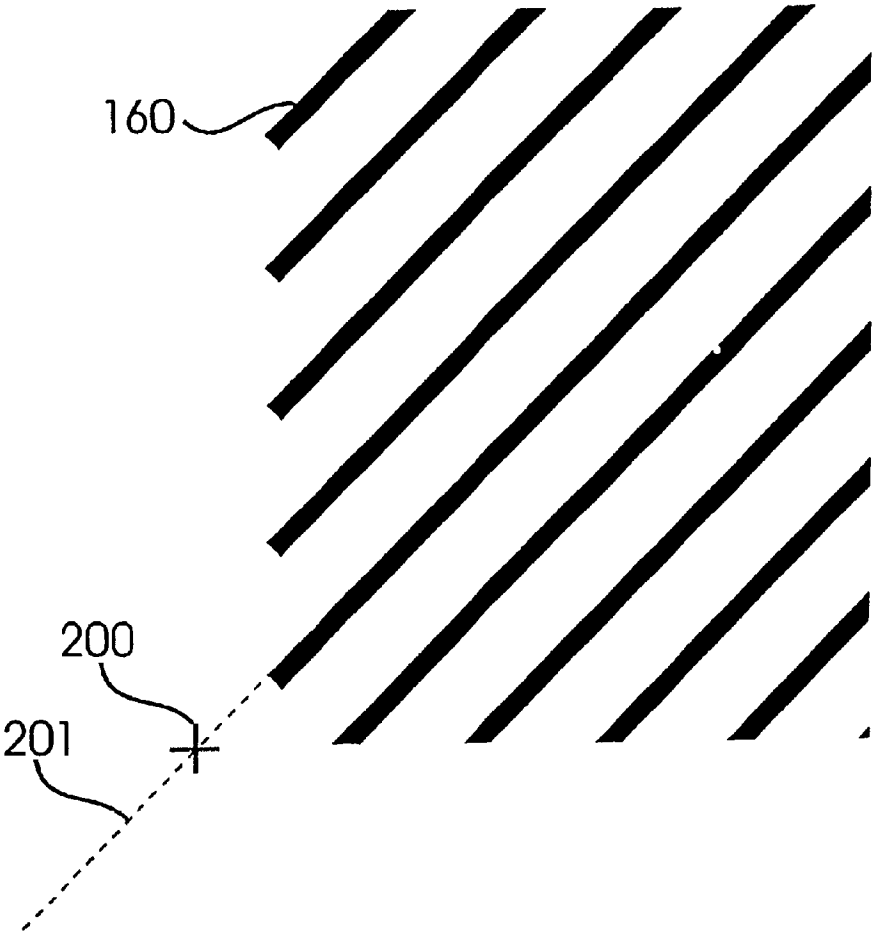
Figure 25C:
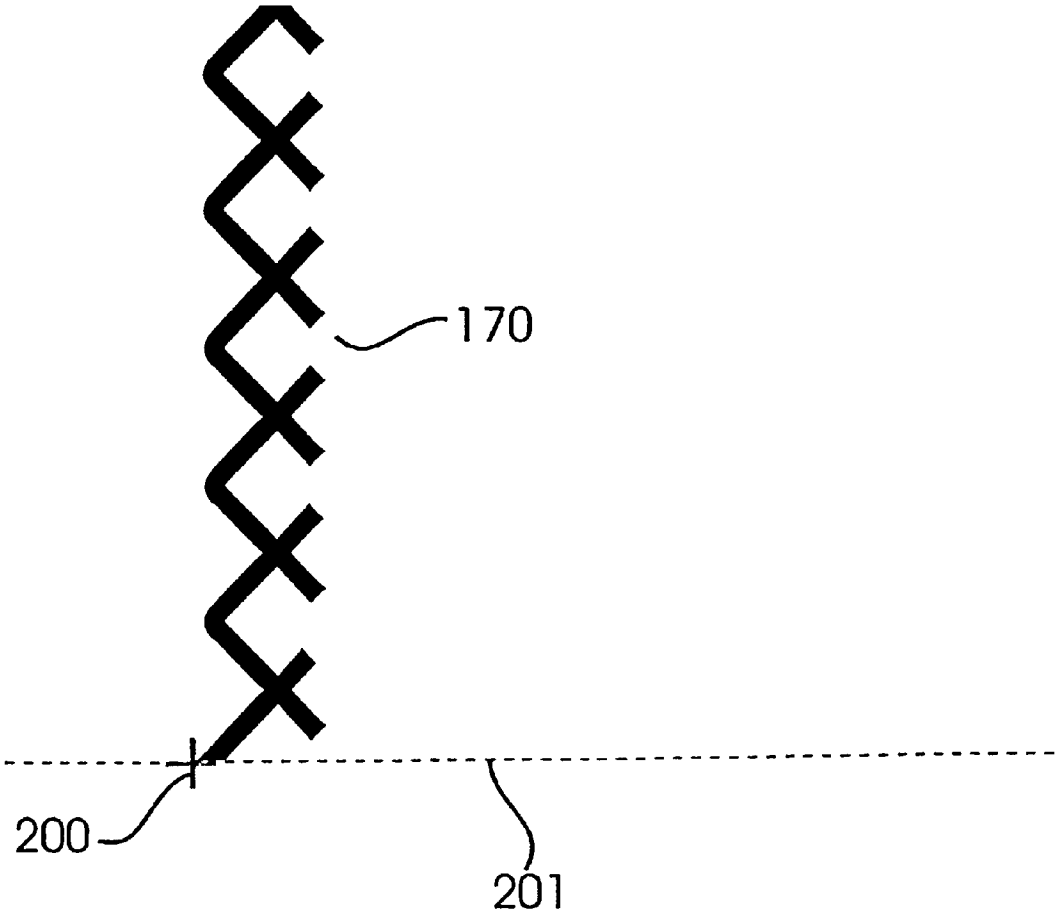
FIG. 25*c* shows an example of an x-ray mask used to expose the grid edge joints of the right-hand-side of a focused grid for a point source shown in FIG. 18 using a sheet x-ray beam according to an embodiment of the present invention.

At least three x-ray masks are required to alleviate this problem and obtain the correct exposure. Each edge joint boundary needs a mask of its own. These are shown in FIGS. 25*a*–25*c*. FIG. 25*a* shows a portion of the grid lines B as lines 150, which do not extend all the way to the grid joint boundary on the left. FIG. 25*b* shows a portion of the grid lines A as items 160, which do not extend all the way to the grid joint boundary on the left. FIG. 25*c* shows the mask for the grid joint boundary on the left. The virtual "+" 200 shows the location of the central ray 63 in FIGS. 25*a*–25*c*. The distances from the joint border to be covered by each mask depend on the grid dimensions, the intended grid height, and the angle.

The exposures of the photoresist 710 by all three masks shown in FIGS. 25*a*–25*c* follow the method described above with regard to FIGS. 21*a* and 21*b* or FIGS. 21*a* and 21*c*. The three masks have to be exposed sequentially after aligning each mask with the photoresist.

Figure 26:
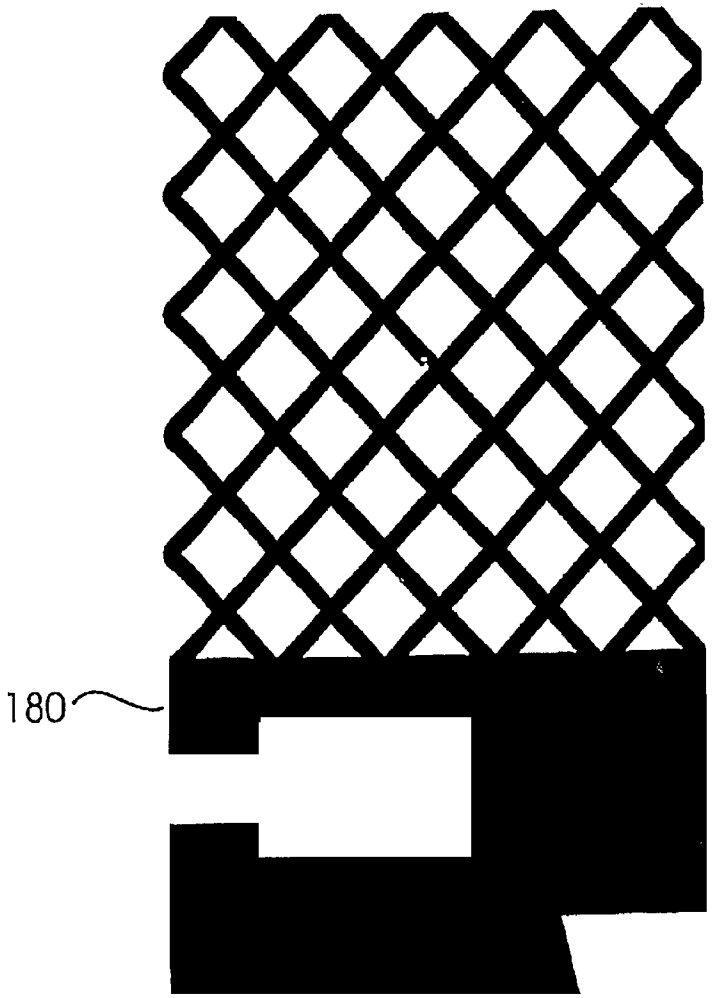
FIG. 26 shows a portion of the grid including the left joining edge and a wide border.
Figure 27:
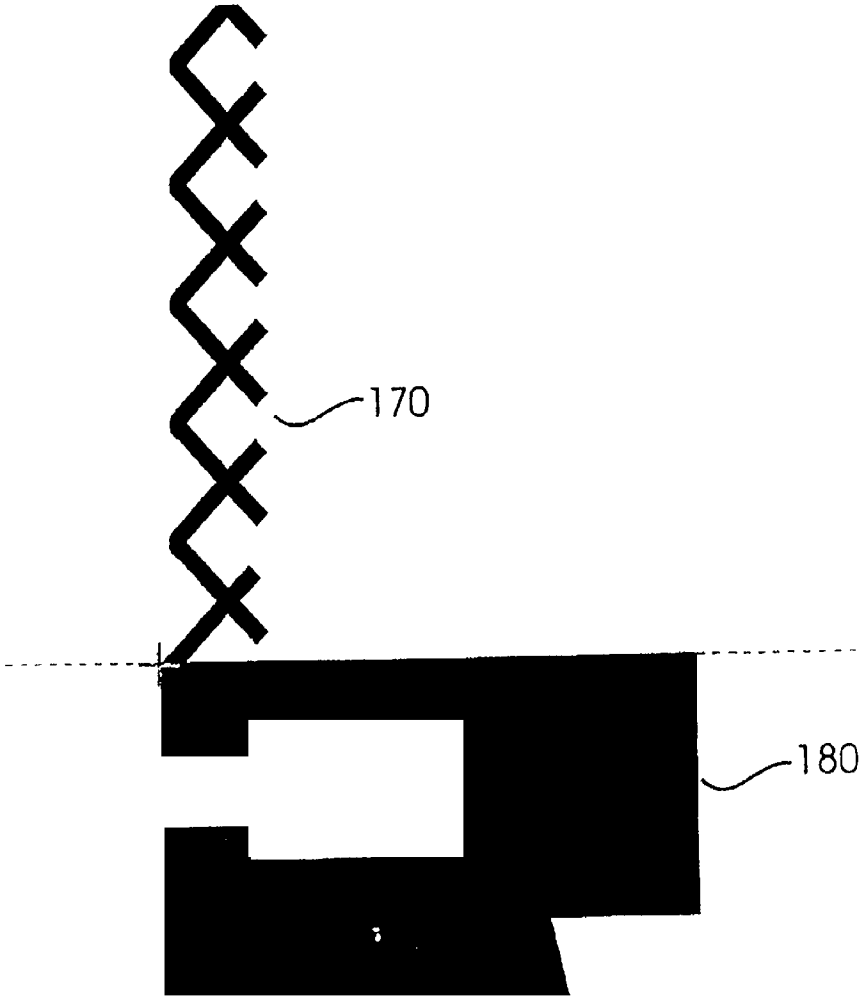
FIG. 27 shows an example of an x-ray mask used to expose the grid edge joint and the border of FIG. 26, which is in addition to the masks already shown in FIGS. 25*a* and 25*b,* according to an embodiment of the present invention.

If this pattern is next to the border of the grid as shown in FIG. 26, then the grid boundary 180 can be part of the mask of the grid joint boundary on the left, as shown in FIG. 27. At a minimum, the grid border 180 consists of a wide grid border for structural support, may also include patterned outside edge for packaging, interlocks and peg holes for assembly and stacking. The procedure would be to expose the photoresist 710 by masks shown in FIGS. 25*a* and 25*b* following the method described in FIGS. 21*a* and 21*b* or FIGS. 21*a* and 21*c*. The exposure of the joint boundary section 170 in FIG. 27 follows the method described in FIGS. 21*a* and 21*b* or FIGS. 21*a* and 21*c* while the exposure of the grid border section 180 in FIG. 27 follows the method described in FIG. 22.

Grid Design Type II For Linear Motion

The exposure of the photoresist for a "tall" type II grid pattern design for linear grid motion, such as those grid patterns illustrated in FIGS. 8, 10, 17, and so on, can be implemented based on the methods described in U. S. Pat. No. 5,949,850, referenced above. The grid is considered "tall" when $$H \sin(\Phi_{max}) >> s,$$

where H is the height of a single layer of the grid, $\Phi_{max}$ is the maximum angle for a grid as shown in FIGS. 2 and 3, and s is related to the thickness of the grid wall as shown in FIGS. 7, 8, 10 and 17. "High" grids are not easy to expose using long sheet x-ray beams when the same grid pattern is implement from top to bottom on the grid.

Figure 28A:
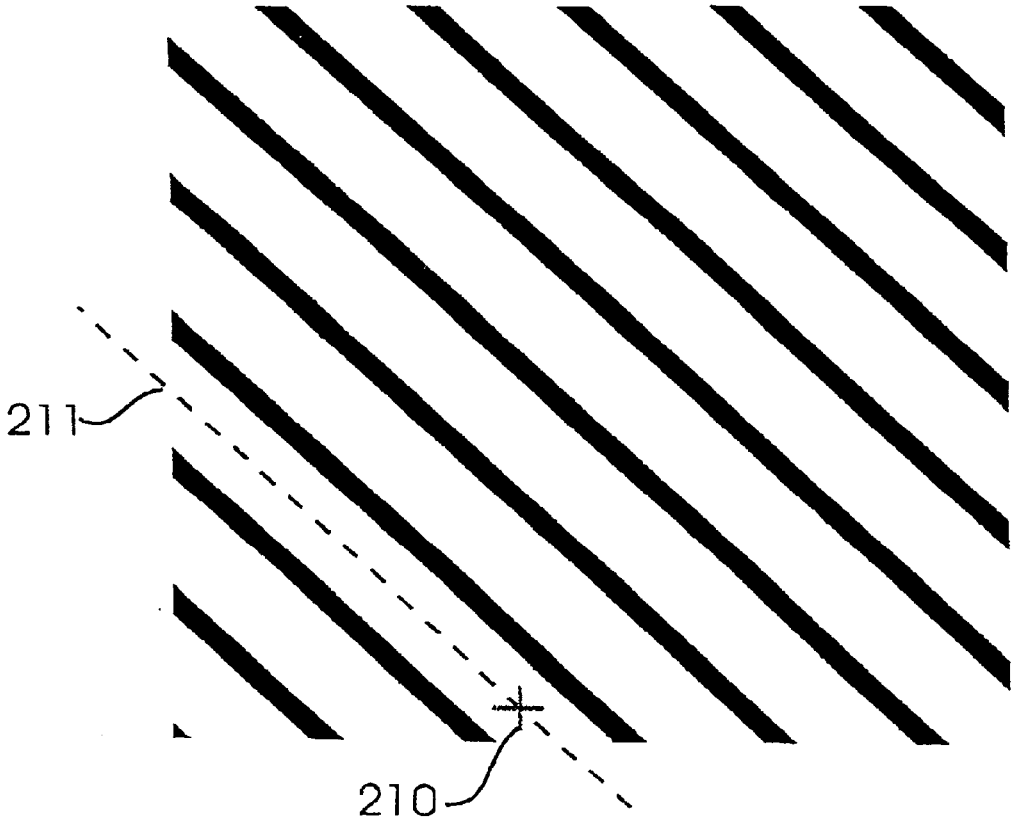
FIGS. 28*a* and 28*b* show an example of an x-ray masks used to expose the photoresist for the focused grids for a point source shown in FIGS. 7, 8, 10 or 17 using a sheet x-ray beam according to an embodiment of the present invention.
Figure 28B:
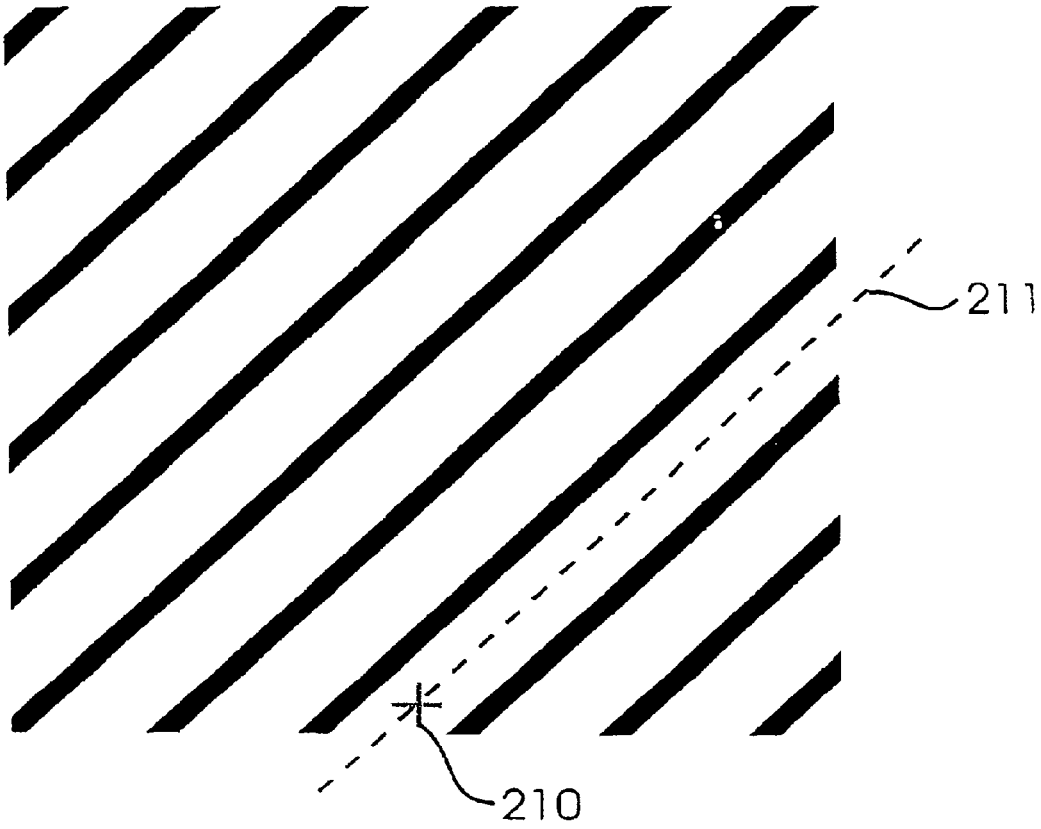
Figure 28C:
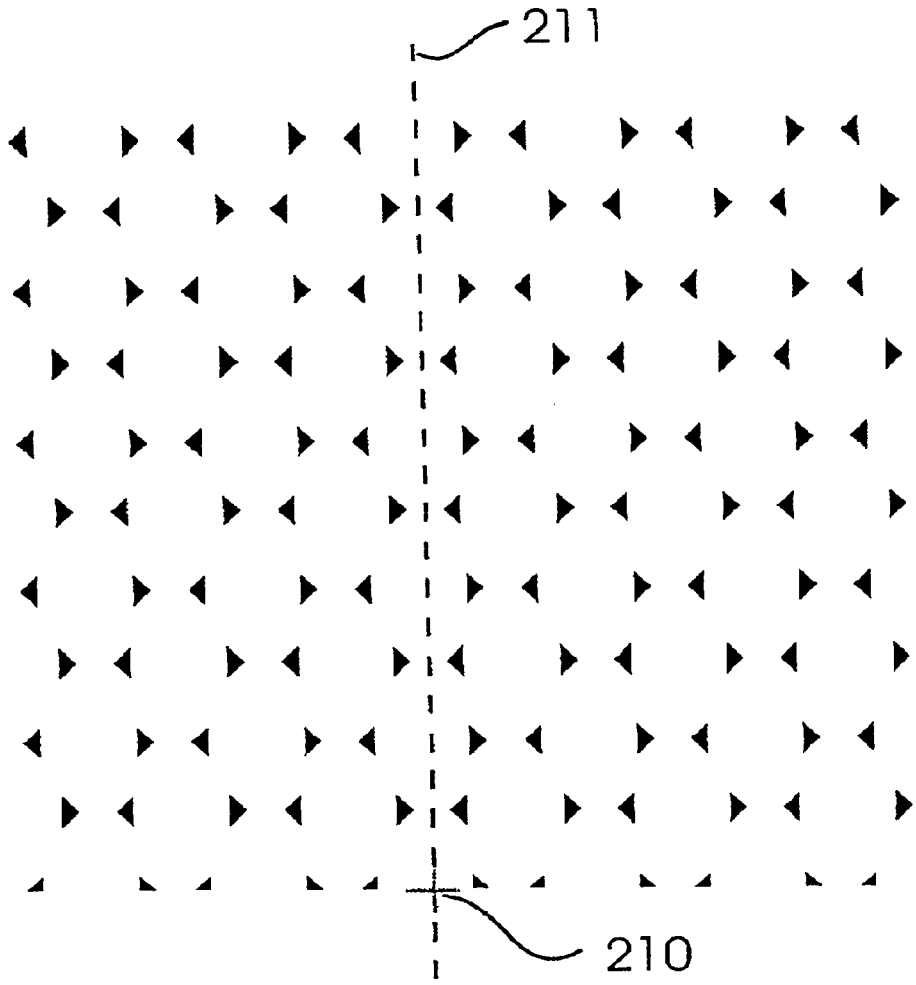
FIG. 28*c* shows an example of an x-ray mask required to expose the additional grid structure for linear motion according to an embodiment of the present invention.

As described in an earlier section, the grid shape shown in FIGS. 8, 10, 17, and so on, need only be just high enough to block the primary radiation without causing undesirable exposure. Using the grid pattern shown in FIG. 10 as an example, three x-ray masks, FIGS. 28*a*, 28*b* and 28*c* can be used for the exposure. Additional x-ray masks might be required for edge joints and borders. The exposure of the photoresist for the joints and borders would be the same as for that describing FIG. 27. The virtual "+" 210 shows the location of the central ray 63 in FIGS. 28*a*, 28*b* and 28*c*. The dashed lines 211 denote the reference line used in the exposure of the photoresist by sheet x-ray beam as described in FIGS. 21*a* and 21*b* or FIGS. 21*a* and 21*c*. The three masks have to be exposed sequentially after aligning each mask with the photoresist.

V. Packaging

The grids have to be assembled, and sealed for protection and made rigid for sturdiness, as will now be described.

1. Assembly: A layer of the grid can be made in one piece or assembled together using a number of pieces and stacking the layers using pegs, as described in U.S. Pat. No. 5,949,850, referenced above.
2. Sturdiness: The grid can be made rigid when two or more layers become physically attached after stacking to make a higher grid. A few of these methods are described below.

The grid and pegs can be soldered together along the outer border.

A layer of the grid, made of lead/tin, can be placed next to a layer of the grid made of a different material such as nickel. When heated, these two layers will be attached. This process can be repeated until the desired height is reached for the grid.

A layer of the grid does not have to be electroplated using just one type of material. For example, either the top or bottom surface. or both surfaces, of a predominantly nickel grid layer can be electroplated with lead/tin next to the nickel before it is polished to the desirable height. When layers of grids made by this approach are stacked together and heated, the various layers become physically connected. This method does not coat the whole grid with solder.

Many parts of an assembled and stacked nickel grid will be fused together when the grid is brought up near the annealing temperature.

Figure 29:
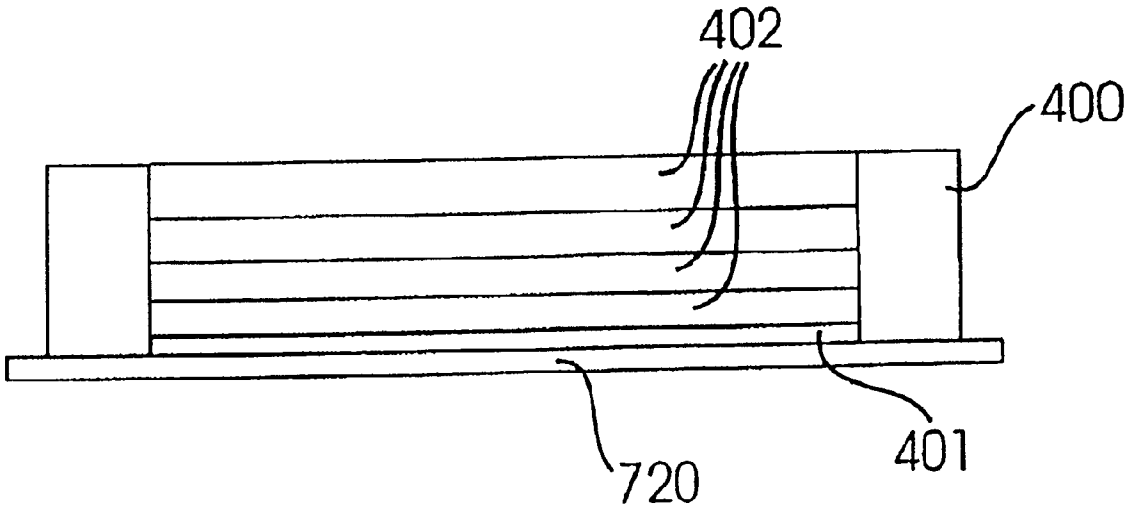
FIG. 29 is a side view of an example of a grid including a frame according to an embodiment of the present invention.

3. Framed Construction: Instead of using pegs and fixed posts, a thick and wide frame can be used for assembly and packaging. FIG. 29 is a side view of the grid showing frame 400. The bottom layer 401 of the grid has extra material at corners of the intersections of its walls as shown, for example, in FIGS. 8, 10 and 17, to provide uniform exposure during grid motion, and the other grid layers 402 do not have extra material at the corners of their wall intersections.

Figure 30:
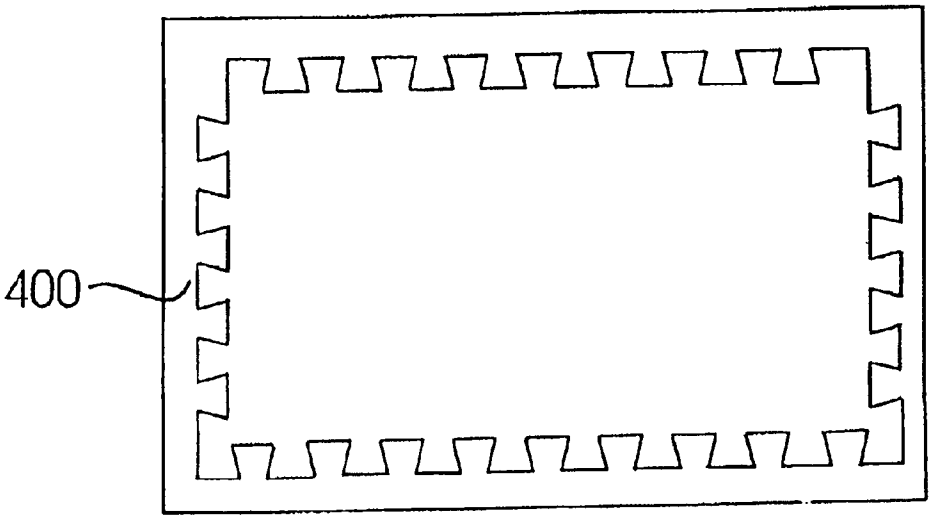
FIG. 30 illustrates a top view of the frame shown in FIG. 29, less the grid layers.

The frame 400 can be made by the SLIGA process as known in the art. FIG. 30 illustrates a top view of an exemplary frame 400. The shape of the frame wall can be any design appropriate for interlocking, and the material of which the frame is made can be any suitable material, as long as it is not excessively soft. Also, the frame 400 can be made by joining two or more pieces together.

Figure 31:
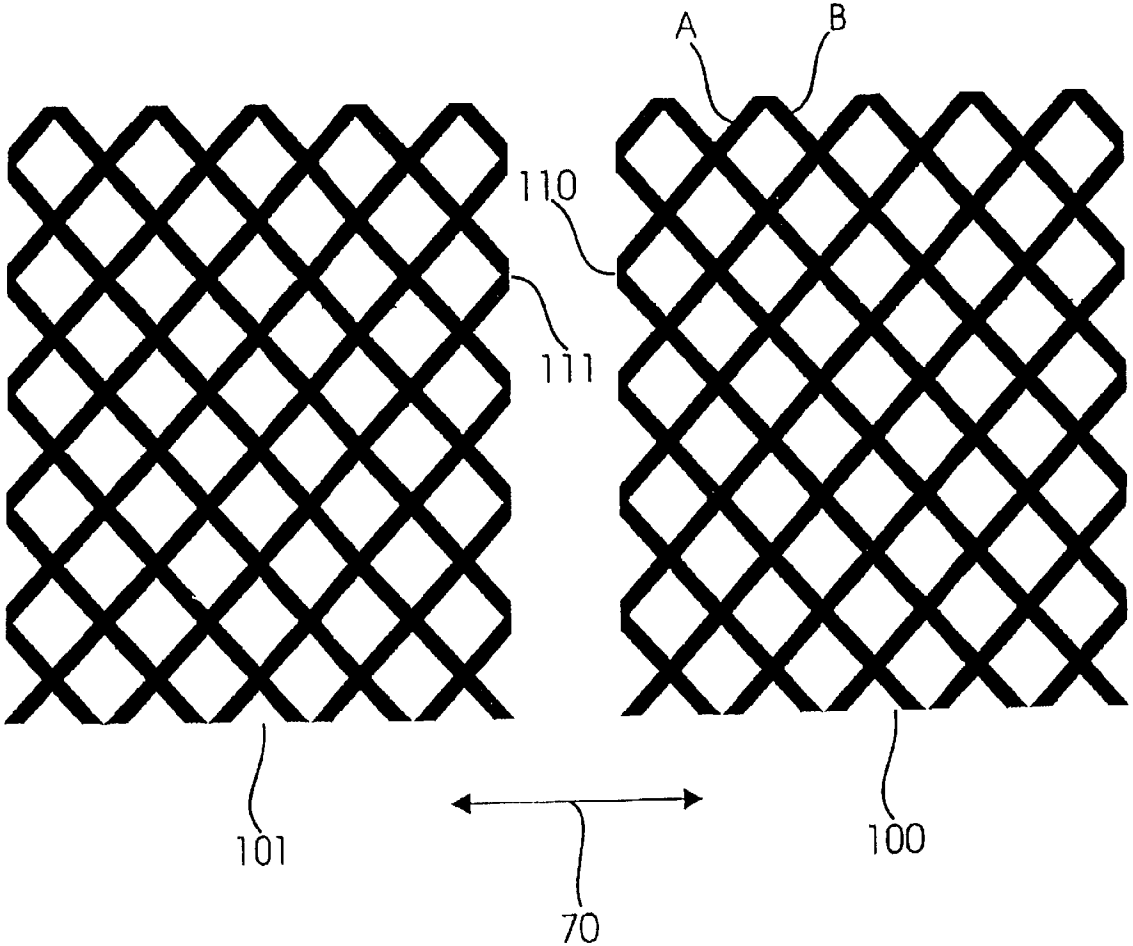
FIG. 31 illustrates pieces of a grid layer that can be assembled in the frame shown in FIGS. 29 and 30.

The grid is assembled by fitting grid layers 401 and 402 into the frame. If grid layer 401 is attached to the substrate but the photoresist is removed, the frame 400 can be fitted over grid layer 401, and the grid layers 402 can then be fit into the frame. Since the frame 400 provides structural support and alignment of the openings in the grid layers 400 and 401, the joints of the grid pieces as shown in FIG. 31 can be relaxed to straight borders 110 and 111, and do not need to be rounded as shown in FIG. 18, for example.

4. Sealing: To protect the assembled grid, the grid has to be covered and sealed using low atomic number materials. There are a wide variety of commercially available choices for sealing material.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A grid, adaptable for use with an electromagnetic energy emitting device, comprising:

at least one metal layer comprising:

top and bottom surfaces and a first and second edge extending in first and second direction transverse of each other;

a plurality of integrated, intersecting walls, each of which extending from said top to bottom surface and having a plurality of side surfaces, said side surfaces of said walls being arranged to define a plurality of openings extending entirely through said layer, each intersection point of said intersection walls including additional wall material in at least one of the metal layers which extends into at least one of said openings;

said each respective additional wall material is arranged such that a total amount of material of said walls intersected by a line propagating in a first direction for the length of one period along the grid is substantially the same for any period along the first direction; and said each respective additional wall material is arranged such that a total amount of material of said walls intersected by a line beginning at said second edge and propagating in a first direction for a first distance including at least one period along the grid and extending substantially parallel to said first edge is substantially the same as another total amount of material of said walls intersected by another line beginning at said second edge at any distance from a point on said second edge from which the first direction extends and propagating in a second direction, substantially parallel to said first direction, for a second distance substantially equal to said first distance.

2. A grid as claimed in claim 1, wherein:

said intersecting walls form said openings in a periodic pattern in a direction along said top surface and in a direction perpendicular to said first direction.

3. A grid as claimed in 1, wherein:

said walls extend between said top and bottom surfaces substantially parallel to each other.

4. A grid is claimed in 1, wherein:

a first group of said walls extending along said grid in a first direction parallel to said top and bottom surfaces are substantially parallel to each other; and a second group of said walls extending along said grid in a second direction parallel to said top and bottom surfaces each extend between said top and bottom surfaces at a respective angle with respect to said top and bottom surfaces to focus at a line extending in a direction substantially parallel to said top surface at a distance from said top surface.

5. A grid as claimed in 1, wherein:

at least one said layer includes a plurality of sections, adapted to couple together to form said at least one said layer.

6. A grid as claimed in claim 1, wherein:

at at least one said intersection point, said respective additional wall material is configured in a plurality of portions extending in opposite directions into different ones of said openings.

7. A grid as claimed in claim 6, wherein:

each of said plurality of portions of said respective additional wall material have substantially the same area.

8. A grid as claimed in claim 6, wherein:

said plurality of portions of said respective additional wall material have areas different from each other.

9. A grid as claimed in claim 1, wherein:

said additional wall material at at least one said intersection point has two portions, each extending from a different one of said walls.

10. A grid as claimed in claim 9, wherein:

said two sides extend substantially perpendicular to each other.

11. A grid as claimed in claim 9, wherein:

said two sides extend at an angle other than 90° with respect to each other.

12. A grid as claimed in claim 1, wherein:

said additional wall material at at least one said intersection point has a side extending in a substantially straight direction between two of said walls.

13. A grid as claimed in claim 1, wherein:

at least one of said openings has a material disposed therein which is adapted to permit said electromagnetic energy to pass therethrough, an a second material suspended in said material which is adapted to substantially prohibit said electromagnetic energy from passing therethrough.

14. A grid as claimed in claim 1, wherein:

at least one of said walls has a thickness different from at least one other of said walls.

15. A grid as claimed in claim 1, wherein:

at least some of said walls intersect at an angle other than 90° with respect to each other.

16. A grid as claimed in claim 1, further comprising a plurality of said layers which are stacked on top of each other such that walls of the layers are substantially aligned so that the openings in the layers are substantially aligned to form openings which pass entirely through the grid.

17. A grid as claimed in 1, wherein:

said additional wall material at each said intersection point is connected to at least one of said walls.

18. A grid as claimed in claim 1, wherein:

said additional wall material at at least one said intersection point is separated from all of said walls.

19. A grid as claimed in 1, further comprising:

at least one second metal layer, comprising:

second top and bottom surfaces; and a plurality of integrated, intersecting second walls, each of which extending from said second top to bottom surface and having a plurality of second side surfaces, said second side surfaces of said second walls being arranged to define a plurality of second openings extending entirely through said second layer; and said first and second layers are stacked on top of each other such that said first and second walls of said first and second layers are substantially aligned so that said first and second openings in said first and second layers are substantially aligned to form openings which pass entirely through the grid.

20. A grid as claimed in claim 19, wherein:

said first layer includes a material different from a material included in said second layer.

21. A grid as claimed in claim 1, comprising:

a plurality of said layers, at least one of said layers including a material different from a material included in any other of said layers.

22. A grid as claimed in claim 1, wherein:

at least one said layer is attached to a substrate.

23. A grid as claimed in 1, wherein:

said walls extend between said top and bottom surfaces at respective angles to focus at a point which is at a distance above or below from said top surface of said grid.

24. A method of motion adaptable for use for x-ray imaging of a grid, comprising the following steps:

moving said grid along a substantially straight line, at a substantially uniform speed, wherein said grid comprises;

at least one metal layer comprising;

top and bottom surfaces and a first and second edge extending in a first and second direction transverse of each other;

a plurality of integrated, intersecting walls, each of which extending from said top to bottom surface and having a plurality of side surfaces, said side surfaces of said walls being arranged to define a plurality of openings extending entirely through said layer;

each intersection point of said intersecting walls including additional wall material in at least one of the metal layers which extends into at least one of said openings;

said each respective additional wall material is arranged such that a total amount of material of said walls intersected by a line propagating in a first direction for the length of one period along the grid is substantially the same for any period along the first direction; and said each respective additional wall material is arranged such that a total amount of material of said walls intersected by a line beginning at said second edge and propagating in a first direction for a first distance including at least one period along the grid and extending substantially parallel to said first edge is substantially the same as another total amount of material of said walls intersected by another line beginning at said second edge at any distance from a point on said second edge from which the first direction extends and propagating in a second direction, substantially parallel to said first direction, for a second distance substantially equal to said first distance; and wherein said moving step moves said grid more than one period during the x-ray imaging.

25. The method according to claim 24, wherein said motion includes:

moving said grid in a forward and reverse oscillatory motion along a substantially straight line, at a substantially uniform speed between each start and stop; and moving said grids more than one period between each start and stop.

26. The method according to claim 24, wherein:

said intersecting walls form said openings in a periodic pattern in a direction along said top surface and in a direction perpendicular to said direction.

27. The method according to claim 24, wherein:

at at least one said intersection point, said respective additional wall material is configured in a plurality of portions extending in opposite directions into different ones of said openings.

28. The method according to claim 27, wherein:

each of said plurality of portions of said respective additional wall material have substantially the same area.

29. The method according to claim 27, wherein:

said plurality of portions of said respective additional wall material have areas different from each other.

30. The method according to claim 24, wherein:

said additional wall material at at least one said intersection point has two portions, each extending from a different one of said walls.

31. The method according to claim 30, wherein:

said two sides extend substantially perpendicular to each other.

32. The method according to claim 30, wherein:

said two sides extend at an angle other than 90° with respect to each other.

33. The method according to claim 24, wherein:

said additional wall material at at least one said intersection point has a side extending in a substantially straight direction between two of said walls.

34. The method according to claim 24, wherein:

at least one of said openings has a material disposed therein which is adapted to permit said electromagnetic energy to pass therethrough, and a second material suspended in said material which is adapted to substantially prohibit said electromagnetic energy from passing therethrough.

35. The method according to claim 24, wherein:

at least one of said walls has a thickness different from at least one other of said walls.

36. The method according to claim 24, wherein:

at least some of said walls intersect at an angle other than 90° with respect to each other.

37. The method according to claim 24, wherein:

said grid further comprises a plurality of said layers which are stacked on top of each other such that walls of the layers are substantially aligned so that the openings in the layers are substantially aligned to form openings which pass entirely through the grid.

38. The method according to claim 24, wherein:

said additional wall material at each said intersection point is connected to at least one of said walls.

39. The method according to claim 24, wherein:

said additional wall material at at least one said intersection point is separated from all of said walls.

40. The method according to claim 24, wherein said grid further comprises:

at least one second metal layer, comprising:

second top and bottom surfaces; and a plurality of integrated, intersecting second walls, each of which extending from said second top to bottom surface and having a plurality of second side surfaces, said second side surfaces of said second walls being arranged to define a plurality of second openings extending entirely through said second layer; and said first and second layers are stacked on top of each other such that said first and second walls of said first and second layers are substantially aligned so that said first and second openings in said first and second layers are substantially aligned to form openings which pass entirely through the grid.

41. The method according to claim 40, wherein:

said first layer includes a material different from a material included in said second layer.

42. The method according to claim 24, wherein:

at least one said layer is attached to a substrate.

43. The method according to claim 24, wherein:

said walls extend between said top and bottom surfaces at respective angles to focus at a point which is at a distance above or below from said top surface of said grid.

44. The method according to claim 24, wherein:

said walls extend between said top and bottom surfaces substantially parallel to each other.

45. The method according to claim 24, wherein:

a first group of said walls extending along said grid in a first direction parallel to said top and bottom surfaces are substantially parallel to each other; and a second group of said walls extending along said grid in a second direction parallel to said top and bottom surfaces each extend between said top and bottom surfaces at a respective angle with respect to said top and bottom surfaces to focus at a line extending in a direction substantially parallel to said top surface at a distance from said top surface.

46. The method according to claim 24, wherein:

at least one said layer includes a plurality of sections, adapted to couple together to form said at least one said layer.

47. The method according to claim 24, wherein:

said additional thicknesses are arranged such that a total length of said walls and said additional thicknesses intersected by a line propagating in the line of grid motion for the length of one period along the grid is substantially the same for any period along the line of grid motion.

48. The method according to claim 24, wherein:

said additional thicknesses are added to said grid by a metal layer comprising only said additional thicknesses attached the substrate.

49. The method according to claim 24, wherein said grid further comprises:

a plurality of said layers, at least one of said layers including a material different from a material included in any other of said layers.

50. A method of motion adaptable for use for x-ray imaging of a grid, comprising the following steps:

moving said grid along a substantially straight line, at a substantially uniform speed, wherein said grid comprises;

at least one metal layer comprising;

top and bottom surfaces that are substantially flat;

two sets of intersecting walls, said surfaces of said walls being arranged to define a plurality of square openings extending entirely through said layers, said intersecting walls form said openings in a periodic pattern, where the periodicity is the dimension of the square;

said squares are substantially 45 degree angle with respect to the line of grid motion;

said grid walls are substantially focused to point above the grid;

said location of the focus of the grid is chosen such that a line drawn from the center of the edge of the grid along the line of grid motion to the focus of the grid walls is substantially perpendicular to the top surface of the grid;

said openings include an additional thickness in the intersection of the walls;

said additional thicknesses are arranged such that a total length of said walls intersected by a line propagating in the line of grid motion for the length of one period along the grid is substantially the same for any period along the line of grid motion;

said additional thicknesses are additionally arranged such that a total length of said walls intersected by a first line propagating in the line of grid motion for a first distance including at least one period along the grid is substantially the same as another total length of said walls intersected by another line substantially parallel to said first line for a second distance substantially equal to said first distance; and moving said grid more that one period during the x-ray imaging.

51. The method according to claim 50, wherein:

said additional thicknesses are added to said grid by a metal layer comprising only said additional thicknesses attached to the substrate.

52. The method according to claim 50, wherein said motion includes:

moving said grid in a forward and reverse oscillatory motion along a substantially straight line, at a substantially uniform speed between each start and stop; and moving said grid more than one period between each start and stop.

53. The method according to claim 50, wherein:

said additional thicknesses are arranged such that a total length of said walls and said additional thicknesses intersected by a line propagating in the line of grid motion for the length of one period along the grid is substantially the same for any period along the line of grid motion.

54. A method of motion adaptable for use for x-ray imaging of a grid, comprising the following steps:

moving a grid assembly along a substantially straight line, wherein said grid assembly comprises a first and second grid, wherein the first grid comprises:

at least one metal layer comprising:

top and bottom surfaces that are substantially flat;

two sets of intersecting walls, said surfaces of said walls being arranged to define a plurality of substantially square openings extending entirely through said layers, said intersecting walls form said openings in a periodic pattern, where the periodicity is the dimension of the square;

said squares are at a substantially 45 degree angle with respect to the line of grid motion;

said grid walls are focused to a point above the grid;

said location of the focus of the grid is chosen such that a line drawn from the center of the edge of the grid along the line of grid motion to the focus of the grid walls is substantially perpendicular to the top surface of the grid;

said second grid is substantially the same as the first grid except that said openings include an additional thickness in the intersection of the walls;

said additional thicknesses are arranged such that a total length of said walls intersected by a line propagating in line of grid motion for the length of one period along the grid is substantially the same for any period along the line of grid motion;

said additional thicknesses are additionally arranged such that a total length of said walls intersected by a first line propagating in the line of grid motion for a first distance including at least one period along the grid is substantially the same as another total length of said walls intersected by another line substantially parallel to said first line for a second distance substantially equal to said first distance;

said first and second grids are substantially aligned;

moving said first and second grid along a substantially straight line at a substantially uniform speed; and moving said grid more than one period during the x-ray imaging.

55. The method according to claim 54, wherein said motion includes:

moving said grid in a forward and reverse oscillatory motion along a substantially straight line, at a substantially uniform speed between each start and stop; and moving said grids more than one period between each start and stop.

* * * * *